US009182091B2

(12) United States Patent
Gershaw

(10) Patent No.: US 9,182,091 B2
(45) Date of Patent: Nov. 10, 2015

(54) LED PANEL LIGHT FIXTURE

(71) Applicant: David Gershaw, Danvers, MA (US)

(72) Inventor: David Gershaw, Danvers, MA (US)

(73) Assignee: RemPhos Technologies LLC, Danvers, MA (US)

( * ) Notice: Subject to any disclaimer, the term of this patent is extended or adjusted under 35 U.S.C. 154(b) by 211 days.

(21) Appl. No.: 13/715,487

(22) Filed: Dec. 14, 2012

(65) Prior Publication Data

US 2014/0168954 A1 Jun. 19, 2014

(51) Int. Cl.

| | |
|---|---|
| ***F21S 4/00*** | (2006.01) |
| ***F21S 8/04*** | (2006.01) |
| ***F21V 5/04*** | (2006.01) |
| ***F21V 15/01*** | (2006.01) |
| *F21Y 101/02* | (2006.01) |

(52) U.S. Cl.

CPC ... *F21S 8/04* (2013.01); *F21V 5/04* (2013.01); *F21V 15/01* (2013.01); *F21Y 2101/02* (2013.01); *Y10T 29/49716* (2015.01)

(58) Field of Classification Search

CPC ..... E04B 9/32; F21S 4/00; F21S 8/00; F21S 8/02; F21S 8/026; F21S 8/04; F21V 7/005; F21V 21/00; F21V 21/002

USPC ..... 362/145–148, 221–224, 225, 227, 240, 362/241, 244–246, 249.01, 249.02, 260, 362/325–327, 364–368, 646, 650, 800

See application file for complete search history.

(56) References Cited

U.S. PATENT DOCUMENTS

| | | | | |
|---|---|---|---|---|
| 5,988,829 | A * | 11/1999 | Holder | 362/223 |
| 6,350,041 | B1 | 2/2002 | Tarsa et al. | |
| 6,515,313 | B1 | 2/2003 | Ibbetson et al. | |
| 6,540,373 | B2 * | 4/2003 | Bailey | 362/150 |
| 6,600,175 | B1 | 7/2003 | Baretz et al. | |
| 6,739,734 | B1 * | 5/2004 | Hulgan | 362/243 |
| 6,906,352 | B2 | 6/2005 | Edmond et al. | |

(Continued)

FOREIGN PATENT DOCUMENTS

| | | | |
|---|---|---|---|
| GB | DB 993402 | * | 5/1965 |
| WO | 02/079689 | A1 | 10/2002 |
| WO | 2010/038946 | A2 | 4/2010 |

OTHER PUBLICATIONS

[No Author Listed] CR24 UPKIT: For CR-LE Light Engine and related Spec Sheet. CREE Lighting. URL: http://www.cree.com/lighting/products/indoor/upgrade-solutions/cr24-upkit. Last Accessed May 30, 2013. 10 pages.

(Continued)

*Primary Examiner* — Hargobind S Sawhney

(74) *Attorney, Agent, or Firm* — Nutter McClennen & Fish LLP

(57) ABSTRACT

Devices, systems, and methods are provided for both retrofitting existing lighting fixtures with LED panels and for installing ceiling tiles having LED modules incorporated therewith. In one exemplary embodiment, a thin panel includes an LED module integrated therewith and the panel is disposed over an opening in a troffer to provide light from the panel-module combination. In another exemplary embodiment, a ceiling tile includes an LED module integrated therewith and the tile is placed in a ceiling grid so light can be provided from that tile. Exemplary configurations of the systems, devices, and kits, as well as methods for installing the same, are also provided.

19 Claims, 19 Drawing Sheets

(56) References Cited

U.S. PATENT DOCUMENTS

| | | | | |
|---|---|---|---|---|
| 6,958,497 | B2 | 10/2005 | Emerson et al. | |
| 7,029,935 | B2 | 4/2006 | Negley et al. | |
| 7,042,020 | B2 | 5/2006 | Negley | |
| 7,211,833 | B2 | 5/2007 | Slater, Jr. et al. | |
| 7,213,940 | B1 | 5/2007 | Van De Ven et al. | |
| 7,252,408 | B2 * | 8/2007 | Mazzochette et al. | 362/294 |
| 7,303,305 | B2 * | 12/2007 | Kennedy | 362/147 |
| 7,312,474 | B2 | 12/2007 | Emerson et al. | |
| 7,446,345 | B2 | 11/2008 | Emerson et al. | |
| 7,614,759 | B2 | 11/2009 | Negley | |
| 7,635,198 | B2 * | 12/2009 | Mayfield et al. | 362/220 |
| 7,645,052 | B2 * | 1/2010 | Villard | 362/147 |
| 7,692,182 | B2 | 4/2010 | Bergmann et al. | |
| 7,692,209 | B2 | 4/2010 | Edmond et al. | |
| 7,722,220 | B2 | 5/2010 | Van De Ven | |
| 7,768,192 | B2 | 8/2010 | Van De Ven et al. | |
| 7,799,586 | B2 | 9/2010 | Leung et al. | |
| 7,852,010 | B2 | 12/2010 | Negley | |
| 7,918,591 | B2 * | 4/2011 | Lynch | 362/365 |
| 7,943,945 | B2 | 5/2011 | Baretz et al. | |
| 7,950,833 | B1 * | 5/2011 | Crane et al. | 362/404 |
| 8,038,318 | B2 * | 10/2011 | Plunk | 362/235 |
| 8,058,659 | B2 * | 11/2011 | Bisberg | 257/88 |
| 8,066,407 | B2 * | 11/2011 | Remus et al. | 362/249.02 |
| 8,174,205 | B2 | 5/2012 | Myers et al. | |
| 8,272,763 | B1 * | 9/2012 | Chinnam et al. | 362/249.07 |
| 8,314,336 | B2 * | 11/2012 | Liang et al. | 174/68.1 |
| 8,702,264 | B1 * | 4/2014 | Rashidi | 362/147 |
| 8,752,976 | B2 * | 6/2014 | Pickard | 362/147 |
| 2011/0310604 | A1 * | 12/2011 | Shimizu et al. | 362/235 |
| 2012/0195032 | A1 * | 8/2012 | Shew | 362/183 |
| 2013/0294059 | A1 * | 11/2013 | Galluccio et al. | 362/218 |
| 2014/0001962 | A1 * | 1/2014 | Harris | 315/153 |

OTHER PUBLICATIONS

[No Author Listed] LED Recessed Troffer Retrofit Kits and Data Sheets for the six models. MaxLite Inc. 2011. URL: http://www.maxlite.com/products/led-recessed-troffer-retrofit-kits. Last Accessed May 30, 2013. 26 pages.

* cited by examiner

LED PANEL LIGHT FIXTURE

FIELD

The present disclosure relates to LED lighting systems that produce light visible to the human eye. More particularly the disclosure relates to improved devices, kits, and methods for either retrofitting existing overhead lighting systems or installing new overhead lighting systems. The disclosure also relates to improved devices, systems, and methods for distributing light. Although the disclosures contained herein are primarily directed to the installation of lighting systems in conjunction with drop down ceilings, those skilled in the art will appreciate the disclosures herein can be adapted for use with a number of other types of ceilings and other structures, fixtures, materials, and components. Likewise, those skilled in the art will appreciate the applicability of the present application with respect to a variety of applications such as general purpose, decretive, ornamental, special effects, automotive lighting, and other.

BACKGROUND

Typically, drop down ceilings, such as the one illustrated in FIG. 1, are used in many commercial and residential building projects when the height of the desired ceiling is lower than the structures actual ceiling height. The drop down ceiling is built using a metal grid which is supported by cables to the actual building. The grid is than populated with ceiling tiles, HVAC ducts and lighting. Such grids have been standardized to 2×2 foot and 2×4 foot sizes in order to make it easier for manufactures of ceiling tiles, HVAC ducts and lighting fixtures to offer standard products.

Lighting fixtures in the 2×2 foot and 2×4 foot sizes have for many years been illuminated using linear fluorescent lamps. These fixtures are sometimes referred to as fluorescent troffers. A fluorescent troffer can include components such as a sheet metal enclosure, a fluorescent ballast, fluorescent lamps and optics to shape the light emitted from the lamps into something pleasing for the environment in which it will be used. A person skilled in the art will recognize three typical types of fluorescent troffers: prismatic, parabolic, and volumetric. One example of a prismatic troffer is illustrated in FIG. 2, and can include, for example, lamps recessed inside the fixture with a lens covering the face of the fixture. One example of a parabolic troffer is illustrated in FIG. 3, and can include, for example, lamps recessed behind or inside cells with no lens covering the fixture. One example of a volumetric troffer is illustrated in FIG. 4, and can include, for example, lamps inside of specially designed reflectors and lenses.

The overall foot print of the various choices of fluorescent troffers, including but not limited to the three main types described herein, are generally the same because they must all drop into 2×2 foot or 2×4 foot grids.

While efforts to make more efficient lighting have led to developments directed to upgrading and replacing fluorescent troffers, such efforts suffer from a number of deficiencies. For example, some efforts that leave existing troffers in place do not improve the overall appearance of the light generated as the old troffers often remain old and dirty. In fact, light that used to be pleasing and have a low glare may be adversely affected. Additionally, because older systems are designed to be used with older technology, the optical efficiency (Lumens per Watt) that exists with newer technology can be lost due to compatibility issues. The optical efficiency (Lumens per Watt) of the total system can be lower than replacement components, or even the old components, and thus the total luminance of the lit space can decrease. Still further, complications can often arise in the re-wiring and re-fitting that is often needed to marry the newer systems with the older systems. Existing retrofitting options can be unreliable at least because the newer components may not fit well with the older components, and the cost associated with purchasing and installing the more efficient lighting can be expensive. New, replacement fixtures are also expensive and can suffer from many of the same complications already discussed. Additional complications can stem from new, replacement fixtures because the ceiling in which the new, replacement fixtures are installed may require modifications to handle different loads.

By way of non-limiting example, one way lighting fixtures having fluorescent tubes are modified to included an LED solution is by replacing the tube with an LED tube having the appropriate sized to fit into the existing fluorescent troffer fixture. The LED tube typically exhibits a Lambertian candela light distribution, as illustrated in FIG. 5. When the LED tube is added to the troffer fixture without any optics, the resulting light distribution from the troffer can also be Lambertian. A person skilled in the art will recognize that Lambertian light distribution is not generally desirable for office-type lighting. Rather, bat wing light distribution, as illustrated in FIG. 6, is more preferable for office environments. Prior to the present disclosure, attempts to achieve bat wing light distribution involved associating secondary optics components with the troffers in which the LED tubes were installed to assist in creating the desired light distribution. Examples of such secondary optics components include a prismatic lens, baffles, or parabolic cells. These attempts, however, particularly in a retrofit setting with LED tubes, were not able to achieve a desirable light distribution. The amount of light for a particular space was often insufficient and included an undesirable amount of glare.

The present disclosure contemplates new and improved devices, kits, and methods for either retrofitting existing overhead lighting systems, or providing new overhead lighting systems that are easier and cheaper to install, perform more efficiently, and minimize and/or overcome many of the aforementioned deficiencies. The present disclosure also contemplates new and improved devices, systems, and methods for improving the distribution of light emanating from a light fixture.

SUMMARY

The present disclosure relates to a new category of fluorescent troffer replacement. This new category is called "drop-in below troffer panel lighting." As described herein, the "drop-in below troffer panel lighting" can retain the fluorescent fixture in its entirety (including the fixture, lamps, ballast), and can include a thin, light weight plastic (or other material) panel with integrated LED lighting system built in. This panel can be easily installed below the existing fluorescent fixture (or inside for prismatic lensed troffers) and can provide for many benefits.

The present disclosure also relates to a new category of troffer that includes an LED light source and can be used as a new, "ceiling tile integrated lighting system." As described herein, the devices, kits, and methods can include, for example, a very thin panel to be used in a retrofit situation, or can be integrated into existing manufactured ceiling tiles for new installations.

Still further, the present disclosure relates to devices, systems, and methods for creating a linear LED light source with a bat wing candela light distribution without the assistance of secondary optics components. Other desirable light distributions created without the assistance of secondary optics components are also contemplated. As a result, the LED light sources provided herein can be used without having secondary optics components disposed over top of the LED light source. Alternatively, to the extend secondary optics components are used in conjunction with LED light sources provided for herein, the secondary optics components can be used for purposes other than forming a desired light distribution configuration, such as to reduce glare or intensity. In one embodiment, the linear LED light source includes LEDs mounted to a circuit board. The circuit board can be attached to a linear optical cavity. The linear optical cavity can include one or more walls that are coated, extruded, or layered to have a highly reflective surface, such as a specular (mirror-type) surface or a diffuser having a reflectively that is approximately equal to or greater than 98%. The linear optical cavity can be made of a variety of materials, including polymers, plastic, metal, metal alloys, and other materials used by those skilled in the art for bending, extruding, and thermoforming. Multiple linear optical cavities can be connected and oriented at various angles with respect to each other to achieve a desired light distribution, such as a bat wing light distribution. A number of factors can impact the resulting light distribution, including but not limited to a size of a complex parabolic body of the light source and the positioning of LEDs along an extrusion axis of the complex parabolic body. As demonstrated herein, there is a unique correlation of the rotated angle of the complex parabolic body and the LED linear positioning along the extrusion axis of the complex parabolic body that can allow for the creation of desired light distributions, including a bat wing candela distribution.

Benefits of the present disclosure include, but are not limited to:

- The existing troffer and fluorescent tubes can be left in place, thereby removing the need for costly and time consuming disposal.
- The old, dirty fluorescent troffer can be covered up. While the fixture can still be in the ceiling, visually the occupants of the lit space will only see a sparkling new modern looking panel that was installed under the old fixture. This can create a better and more productive environment for those occupants using the lit space.
- High fixture efficiency. Because the fixture is designed from scratch to take advantage of LED, the fixture can have the highest possible Lumens per Watt efficiency.
- There are no safety related issues. The fixture is designed from scratch to correctly provide safety features specific to LED technology. There is no anticipated risk of a future maintenance person attempting to install fluorescent tubes when components associated with the present disclosure are in place.
- Light output and distribution can be very well designed.
- Glare. The system can be designed to properly reduce or control glare.
- Reliability. Because the designs described herein can include ample room for proper thermal management, the system can run in safe temperature ranges for the long period of life of the LED and the driver.
- Inexpensive cost and simple build. In some embodiments, almost the entire lighting system can be made of plastics. Thermal management can be handled at the LED level by running extremely efficient (120LPW+) LEDs at low currents (0-100 mA), and thus additional thermal management is not generally required. In some embodiments, LEDs can be mounted on MPCB, FR4 or even plastic circuits printed with electrically conductive inks, thereby providing further cost savings. The extremely low number of parts on the bill of materials makes this extremely cost effective to manufacture.
- Easy to install because the components of the devices and kits described herein can fit into existing ceiling grid.
- In embodiments that primarily rely upon plastic construction, the systems are durable and non-fragile.
- Simplicity of transportation/installation. Because these systems can be extremely light weight, they can be very easy items to package efficiently and transport inexpensively. In addition, the light weight design can make them easy to install for someone standing on top of a ladder. A risk of dropping the LED fixture during the assembly is very small. And if it does fall, it will most likely not sustain any damage.

A person skilled in the art will recognize that there are many methods by which this invention can be carried out, and thus to the extent the present disclosure focuses on a particular method and associated variations for description purposes, such method is in no limits the scope of the invention. No preference has been taken to the selection of choosing to describe this method, since the main goal of this application is the concept of either a panel containing an integrated luminaire that will reside below or inside an existing fluorescent troffer or integrating the same luminaire inside of a ceiling tile. A person skilled in the art would be able to come up with additional modes for carrying out this invention without departing from the spirit of the present disclosure.

In one exemplary embodiment a method for installing a lighting element in a pre-installed troffer can include selecting a thin panel that is sized to fit an opening of the troffer. The panel can also have at least one LED module integrated therewith. The method can further include removing electrical enclosures of the troffer to provide access to electrical connections. This can result in the troffer serving as a junction box. The at least one LED module can be electrically connected to the electrical connections, after which at least a portion of the removed electrical enclosures of the troffer can be re-installed if desired. The thin panel with which the LED module is associated can then be positioned at or below a bottom portion of the troffer. In some embodiments, a driver can be mounted adjacent to the thin panel and electrically connected to the LED module. In other embodiments the driver can be integrated with the LED module prior to installation of the panel. An installer can disconnect a line potential from a ballast of the troffer. Further, in some embodiments a weight of the thin panel and the at least one LED module can be negligible such that a cabling system associated with the troffer does not require adjustment to account for additional weight of the light fixture.

In another exemplary embodiment a method for installing a light fixture can include selecting a ceiling tile having an optical body with at least one parabolic-shaped cavity with an inner surface that includes at least a portion thereof that is reflective and at least one LED module attached to the inner surface of the optical body, electrically connecting the at least one LED module to electrical connections disposed adjacent to a ceiling grid, and positioning the ceiling tile in the grid. In some embodiments the ceiling tile can have a junction box integrated therewith, with the junction box being configured to be part of the electrical connections made between the at least one LED module and the electrical connections disposed adjacent to the ceiling grid. A location of the ceiling tile can be selected such that it is adjacent to a junction box, and then the junction box can be used to make electrical connections between the at least one LED module and the electrical connections disposed adjacent to the ceiling grid. Further, in some embodiments a weight of the ceiling tile and the at least one LED module can be negligible such that a cabling system associated with the ceiling tile does not require adjustment to account for additional weight of the ceiling tile and the at least one LED module.

One exemplary embodiment of a light fixture can include a thin panel, an optical body integrated with the thin panel, at least one LED module, and a troffer. The optical body can have at least one parabolic-shaped cavity, the cavity having an inner surface that includes at least a portion that is reflective. The LED module can have an LED package in electrical communication with a driver, the LED package can be mounted to a circuit board, and a at least one of the circuit board and the LED package can be coupled to the inner surface of the optical body. The troffer can have a top, a bottom, and a ballast compartment, with the bottom having an opening through which light can pass, and the ballast compartment having a configuration to provide electrical connections to the driver and the LED package. The thin panel can be configured to mate to the troffer to cover at least a portion of the opening of the troffer such that light from the LED module is reflected out of the optical body by a portion of the inner surface that is reflective from a location that is below the top of the troffer. In some embodiments, the driver can be disposed within the LED module, while in other embodiments the driver can be remote from the LED module. The LED module can include optics configured to assist in focusing light emanating from the LED module and/or assist in reducing glare from light emanating from the LED module and/or assist in reducing hot spots of the LED module. Further, a diffuser can be included, with the diffuser being configured to assist in reducing glare from light emanating from the LED module. In some embodiments, the LED module can be made completely of plastic.

Another exemplary embodiment of a light fixture can include a ceiling tile having a front face and a back face, an optical body mounted to the front face of the ceiling tile, at least one LED, module, and a junction box located proximate to the back face of the ceiling tile. The optical body can have at least one parabolic-shaped cavity, the cavity having an inner surface that includes at least a portion that is reflective. The LED module can include an LED package in electrical communication with a driver, with the LED package being mounted to a circuit board, and at least one of the circuit board and the LED package can be coupled to the inner surface of the optical body. The junction box can be configured to provide electrical connections to the driver and the LED package. Further, electrical power can be provided to the junction box, and thus to the driver and the LED package, such that light from the LED module is reflected out of the optical body to an outside enviroment by a portion of the inner surface that is reflective. In some embodiments the driver can be disposed within the LED module, which in other embodiments the driver can be located remote from the LED module, for instance proximate to the back face of the ceiling tile. The LED module can include optics configured to assist in focusing light emanating from the LED module and/or assist in reducing glare from light emanating from the LED module and/or assist in reducing hot spots of the LED module. Further, a diffuser can be included, with the diffuser being configured to assist in reducing glare from light emanating from the LED module. In some embodiments, the LED module can be made completely of plastic.

An exemplary embodiment of a kit for installing a light fixture can include one or more thin panels and/or one or more ceiling tiles, as well as an optical body configured to be integrated with either or both of the panels and tiles, at least one LED module, and an instruction manual. The optical body can have at least one parabolic-shaped cavity, the cavity having an inner surface that includes at least a portion that is reflective. The at least one LED module can have an LED package in electrical communication with a driver, the LED package can be mounted to a circuit board, and at least one of the circuit board and the LED package can be coupled to the inner surface of the optical body. In kits that include one or more thin panels, the instruction manual can include directions for installing the one or more thin panels integrated with the optical body and the at least one LED module over a troffer. In kits that include one or more ceiling tiles, the instruction manual can include directions for installing the one or more ceiling tiles integrated with the optical body and the at least one LED module in a ceiling grid. The instruction manual can include both types of directions as well. The directions can be based, at least in part, on the methods disclosed herein for installing a light fixture in conjunction with a thin panel and/or a ceiling tile.

In accordance with one method of carrying out this invention, a method of design for such a panel is disclosed. A choice of LED module is chosen. A plastic panel or ceiling tile is chosen. The LED module can be integrated onto the plastic panel or ceiling tile. The installation in the field for the retrofit can include, for example, first removing the prismatic lens or releasing the parabolic of volumetric enclosure. Next the enclosure on the existing fluorescent troffer can be removed, thereby providing the installer access to the electrical connections. The line potential can be disconnected from the fluorescent ballast. The new LED driver can be mounted near the fluorescent ballast. A person skilled in the art will recognize that in embodiments in which the LED panel has an integrated driver, the step of mounting the LED driver near the fluorescent ballast can be omitted. The cable from the LED driver can be allowed to hang down through the fixture and the original electrical enclosure can be re-installed. In the case of a prismatic lensed troffer, the prismatic lens can be removed and disposed of and the LED panel can be installed in its place. In the case of any other style fluorescent troffer, the LED panel can be installed below the existing fixture between the supporting ceiling grid and the existing fixture. In the case of new installation in accordance with the present disclosure, the LED module is chosen, a ceiling tile is chosen, and a junction box is chosen. The LED module can be integrated into the ceiling tile. The junction box can also be integrated into the ceiling tile. The installation in the field for the new installation can include, first making the necessary electrical connections and then dropping the LED panel into the ceiling grid. A person having skill in the art will understand other types of steps that can be necessary to perform in order to perform either a retrofit or a new installation in accordance with the present disclosure.

One exemplary embodiment of an LED module can include a linear optical body having opposed first and second complex parabolic bodies, a first circuit board having at least one LED disposed thereon and mounted to the first complex parabolic body, and a second circuit board having at least one LED disposed thereon and mounted to the second complex parabolic body. A distribution of light from the at least one LED of the first circuit board and the at least one LED of the second circuit board can have a bat wing distribution that is not the result of passing light through a secondary optics component, i.e., the resulting distribution is not affected by any secondary optics component. A person skilled in the art will recognize that other desirable light distributions that are not necessarily bat wing distributions can also be achieved. A distribution of light as described herein generally refers to directing light to particular locations and/or not directing light to other particular locations as desired, and is referenced herein interchangeably at least as a distribution of light, light distribution, and light distribution configuration. Thus, as described, secondary optics components do not substantially change the location of where light is directed and where light is not directed. Each inner surface of the parabolic bodies can be configured to reflect light. In some embodiments the inner surfaces can be coated with a reflective material. In other embodiments a reflective diffuser can be mounted on an inner surface of the linear optical body. In still other embodiments the inner surface can be part of a highly reflective extruded material.

A first angle formed by a central axis of the first complex parabolic body and a central axis of the linear optical body can be approximately in the range of about 15 degrees to about 60 degrees, and a second angle formed by a central axis of the second complex parabolic body and the central axis of the linear optical body can be approximately in the range of about 15 degrees to about 60 degrees. In one embodiment the first angle and the second angle are both approximately 30 degrees. A glare reduction lens can be mounted over at least the LEDs of the first and second circuit boards. Although a glare reduction lens can be a secondary optics component, a person skilled in the art will recognize it does not substantially change a location of where light is directed and where light is not directed. In some embodiments a first fin can extend in a generally transverse direction from the first complex parabolic body and a second fin can extend in a generally transverse direction from the second complex parabolic body. An angle formed by at least one of the first and second fins and a transverse plane extending across a bottom of the linear optical body can be greater than zero. Alternatively, the first and/or second fins can extend substantially parallel to or collinear with the transverse plane extending across the bottom of the linear optical body. Another feature of the LED module can be an accessory mount coupled to the first and second fins. In some embodiments the accessory mount can extend above the linear optical body. Yet another feature of the LED module can be one or more sideways-mounted LEDs disposed below the first and second fins. The sideways-mounted LEDs can be configured to illuminate by a battery source. Such sideways-mounted LEDs can be useful, for example, in emergency situations.

The first and second circuit boards can be mounted in a variety of configurations. In some embodiments the first and second circuit boards can be mounted along a central axis of the first and second complex parabolic bodies. In some other embodiments the first and second circuit boards can be mounted between central axes of the first and second complex parabolic bodies and the respective inner walls of the first and second complex parabolic bodies. For example, the first and second circuit boards can be mounted on the respective inner walls of the first and second complex parabolic bodies. In still some other embodiments the first and second circuit boards can be mounted between the central axes of the first and second complex parabolic bodies and the respective outer walls of the first and second complex parabolic bodies. A person skilled in the art will recognize that these circuit board locations can be mixed and matched to create additional light distribution options, either with the described mounting configurations or other potential mounting configurations derivable based on the teachings provided herein.

The LED module can be coupled to a thin panel or a ceiling tile. In some embodiments one or more mounting features can extend transversely from opposed sides of the thin panel. Such features can assist in mounting the thin panel in a ceiling grid.

An exemplary method for distributing light can include positioning a panel coupled to a light source in a ceiling and directing light from the light source to a location below the ceiling in a bat wing distribution configuration that is not the result of passing the light through a secondary optics component. The light source can include a linear optical body and one or more LEDs coupled thereto. In some embodiments the method can include adjusting at least one of a size and a shape of the linear optical body to adjust the bat wing distribution configuration to a desired configuration. The linear optical body can include a plurality of complex parabolic bodies. In such instances, the method can include adjusting at least one of a size of the plurality of complex parabolic bodies and angles formed by the complex parabolic bodies relative to a transverse plane extending across a bottom of the linear optical body to adjust the bat wing distribution configuration to a desired configuration. Additionally, in some embodiments the method can include adjusting a location of the one or more LEDs relative to the linear optical body to adjust the bat wing distribution configuration to a desired configuration. While secondary optics components can be used in conjunction with the disclosures herein as a further way to adjust a light distribution, in some embodiments no secondary components are included as part of the light source. In some other embodiments, one or more secondary optics components is included but such component(s) does substantially change the location of where light is directed and where light is not directed. In still other embodiments the secondary optics components can provide further adjustment of the desired light distribution configuration.

The advantages of the present application include improved methods, devices, systems, and kits for either new or retrofit 2×2 foot, 2×4 foot, or other sizes for that matter, of lighting a space with overhead ceiling grid, and improved methods, devices, systems, and kits for providing desirable light distributions.

BRIEF DESCRIPTION OF DRAWINGS

The application may take form in various components and arrangements of components, and in various steps and arrangements of steps. The drawings are only for purposes of illustrating the preferred embodiments and are not to be construed as limiting the application. This invention will be more fully understood from the following detailed description taken in conjunction with the accompanying drawings, in which.

DETAILED DESCRIPTION

Figure 1:
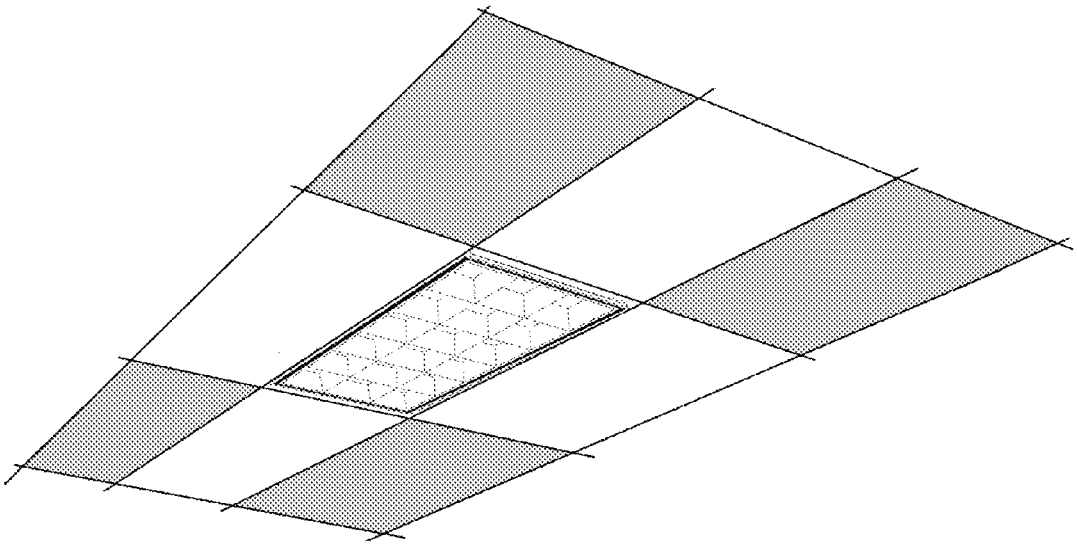
FIG. 1 PRIOR ART
FIG. 1 is an isometric view of a ceiling grid with a fluorescent fixture installed as known in the prior art.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. By way of non-limiting example, disclosures directed to ceiling tiles with LED modules and the installation of a new ceiling tile associated with an LED module can be easily adapted by a person skilled in the art to be applicable to disclosures directed to thin panels with LED modules and the installation of a thin panel associated with an LED module in conjunction with a retrofit, and vice versa.

One aspect of the present disclosure relates to systems and devices that can be used to replace existing overhead lighting, or which can be used as a new form of overhead lighting. As described herein, an LED panel light can be mounted on a ceiling tile or on a thin replacement panel. The disclosures also contemplate a variety of methods that can be used to replace current light sources with an LED light source, such as by replacing existing fluorescent troffer fixtures, and methods for installing new light sources where light fixtures previously did not exist.

Another aspect of the present disclosure relates to systems and devices that can be used in conjunction with improving the distribution of light from lighting sources, such as LED modules. The LED modules described herein allow for a variety of desirable light distribution configurations to be created without using secondary optics components. Although the present disclosure primarily discusses LED light sources, a person skilled in the art will understand that these disclosures can also be applied to Lambertian light sources. Further, a person skilled in the art will recognize various types of secondary optics components, which include but are not limited to various types of lenses. The size, shape, and general configuration of linear optical bodies or cavities of the modules can be adjusted to affect the light distribution. Additionally, or in lieu of, a size, shape, configuration, and general location of LEDs associated with the linear optical bodies or cavities can be adjusted to affect the light distribution.

While the present description and figures primarily discuss the light sources described herein as being used in overhead lighting in conjunction with a ceiling grid, a person skilled in the art will recognize that the light sources disclosed herein, and methods related to the same, can be used in various other ceiling constructions, as well as across a number of other industries in a variety of different configurations. Accordingly, the disclosures herein are not limited to uses in ceilings. By way of non-limiting examples, the light sources described herein can be incorporated into walls, floors, or stand-alone components that provide light, such as billboards and signs. Additionally, a person skilled in the art will recognize that although the devices, systems, kits, and methods discussed herein are primarily discussed with respect to ceiling grid lighting, the disclosed devices and methods can also be used in conjunction with manufacturing new devices and systems in any number of industries.

In the following description, well-known functions or constructions are not described in detail to avoid obscuring the main subjects of the disclosure in unnecessary detail.

Figure 7A:
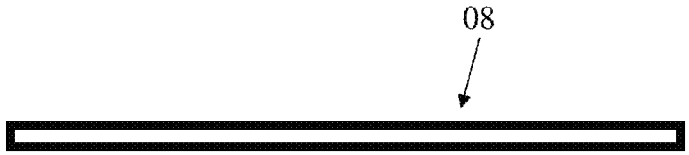
FIG. 7A is a side profile view of one exemplary embodiment of a thin panel or ceiling tile.
Figure 7B:
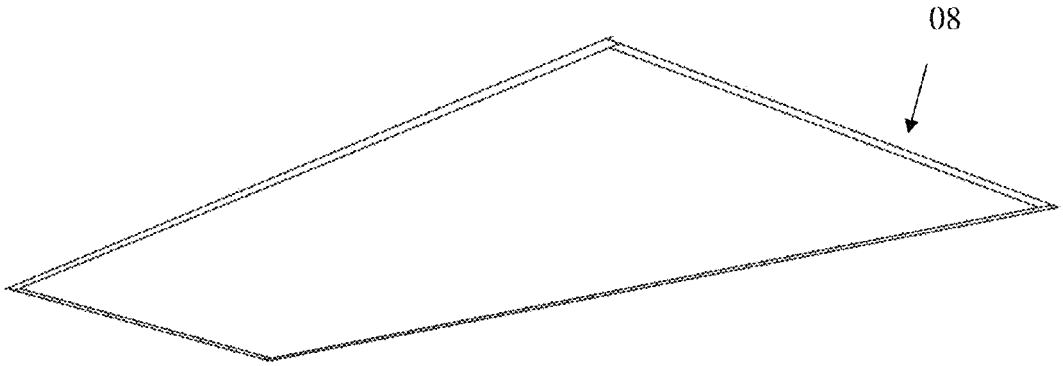
FIG. 7B is an isometric view of the thin panel or ceiling tile of FIG. 7A.

With reference to FIGS. 7A and 7B, an illustration of a thin panel 08 is shown. As made clear by descriptions herein, the thin panel 08 can also be a ceiling tile. The thin panel 08 can be configured in a manner that is complementary to the size and shape of a location in which it will be placed. For instance, if the panel 08 is to be placed over an opening of a fluorescent troffer, the panel 08 can be sized and shaped to cover the opening. Accordingly, a person skilled in the art will recognize that a common size for the thin panel 08 may be approximately 2 feet by approximately 4 feet, which is similar to a size of a common ceiling tile or fluorescent troffer. A thickness of the panel can be thin, for instance in the range of about 1/32 of an inch thick to about 1 inch thick, and in one embodiment it is about 1/8 of an inch thick. Although in the embodiments described herein the panels are generally described as covering an opening of a troffer or a ceiling grid, in some embodiments it may be desirable to only cover a portion of the opening of a troffer or a ceiling grid, and thus the panels can be sized accordingly. The thin panel can be made of any number of materials, including but not limited to plastic and/or any commercially available polymeric resin. The thin panel can be light weight, thin, and rigid enough to support the weight of an LED module that will be integrated into it and support itself in the ceiling grid. By making the thin panel light weight and unobtrusive, the panel can be installed without requiring accommodations or changes be made to the remaining ceiling structure to support the thin panel and components, such as LED modules, associated therewith.

Figure 8:
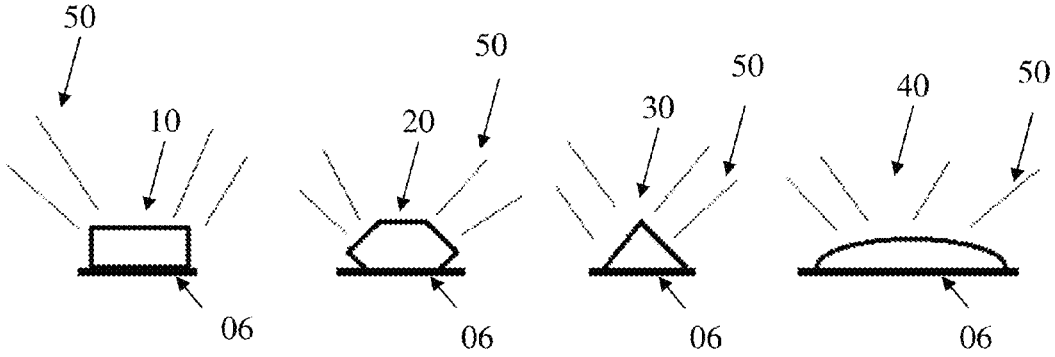
FIG. 8 is a side profile view of exemplary embodiments of differently shaped LED modules.

With reference to FIG. 8, an illustration of multiple types of LED modules is shown. The LED modules can include LED packages mounted to a circuit board, as shown a printed circuit board (PCB) 06, and inserted into an extrusion, injection molded, or thermoformed lens, which is typically, but not necessarily, plastic that can aid in directing light from the LED packages in a certain direction for light distribution control. While a person having skill in the art would understand how to piece the components such as the LED package, circuit board, and plastic piece together to form an LED module, examples of LED modules that can be used in conjunction with present disclosures are provided further below.

In the illustrated embodiment, four differently shaped LED modules are provided: a rectangular module 10, a hexagonal module 20, a triangular module 30, and an elliptical module 40, each of which shows light 50 being emitted therefrom. A person skilled in the art will recognize that any other number of shapes can be used to form LED modules for use in conjunction with the devices, systems, and methods provided for herein. Further, these modules can be constructed from extremely efficient LEDs, for example having a rating of 120 Lumens per Watt or greater, to minimize or eliminate any need for significant thermal management to operate properly. Once one or more LEDs are mounted to the PCB, any of these modules can be used as the carrier for the light sources. The modules may or may not include additional optics/diffusion for focusing the beam of light or reducing glare or hot spots. The module may also include screen type diffusion over the entire module for both reduction in glare and attractive appearance of the finished light panel. Additionally, the LED modules can be made from any number of materials known to those skilled in the art, including but not limited to polymers. In one exemplary embodiment the entire LED module is made of plastic.

Figure 9:
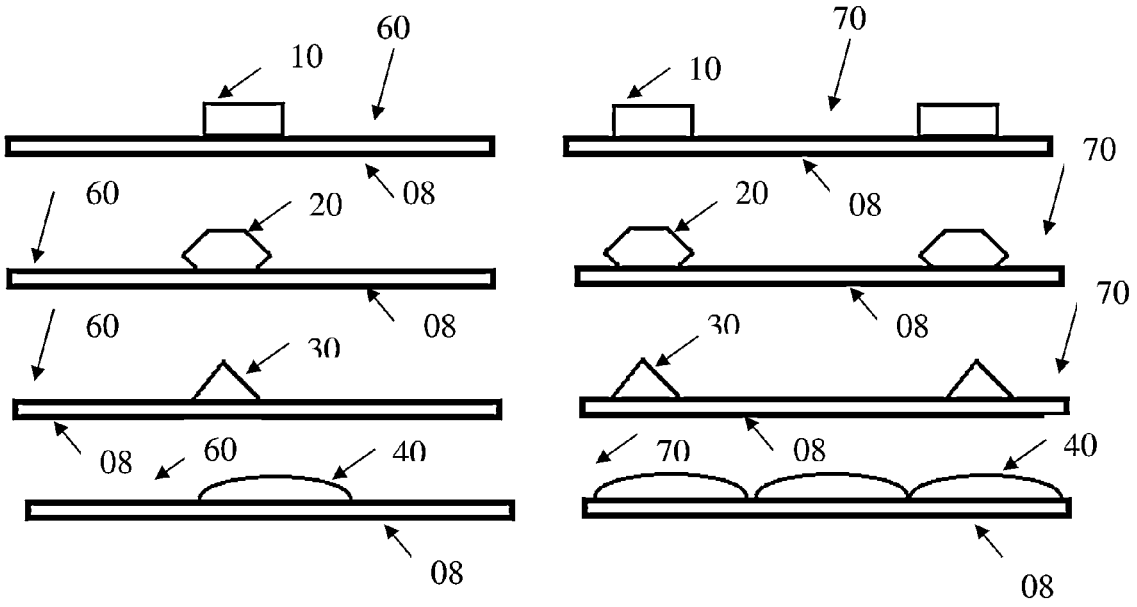
FIG. 9 is a side profile view of the LED modules of FIG. 8 integrated with the thin panel or ceiling tile of FIGS. 7A and 7B.

With reference to FIG. 9, illustrations of the LED modules 10, 20, 30, and 40 integrated to the thin panel 08 of FIGS. 7A and 7B are shown. Alternatively, the thin panel 08 can be a ceiling tile in accordance with disclosures provided herein. The LED modules can be integrated with the panel 08 in such a way that the finished system looks cosmetically pleasing and has a rigid reliable bond. As shown, in some embodiments a single LED module 10, 20, 30, 40 can be integrated with the panel 08 to form the LED panel 60, while in other embodiments multiple LED modules 10, 20, 30, 40 can be integrated with the panel 08 to form the LED panel 70. A person skilled in the art will recognize that any number of similarly or differently designed and shaped LED modules can be mixed and matched to create the LED panel 70. A back side of the LED panel 60, 70 can be flat, which can be helpful for retrofit installations because it can generally sit directly below an existing fluorescent fixture.

Figure 2:
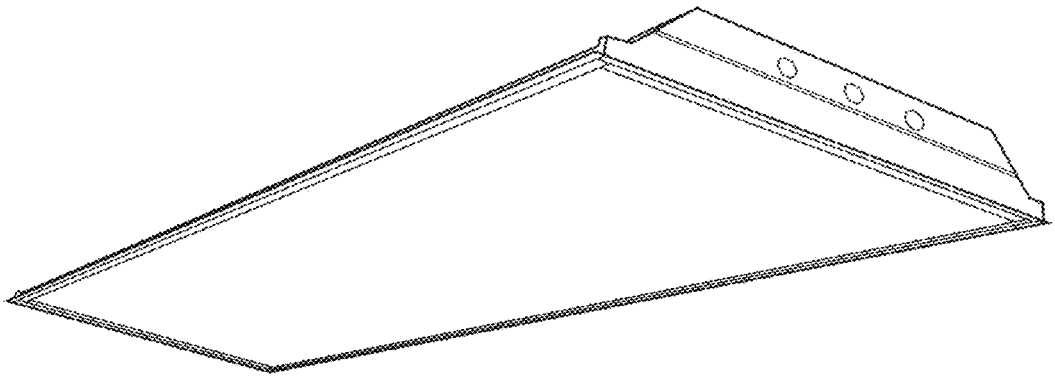
FIG. 2 PRIOR ART
FIG. 2 is an isometric view of a prismatic fluorescent fixture as known in the prior art.
Figure 3:
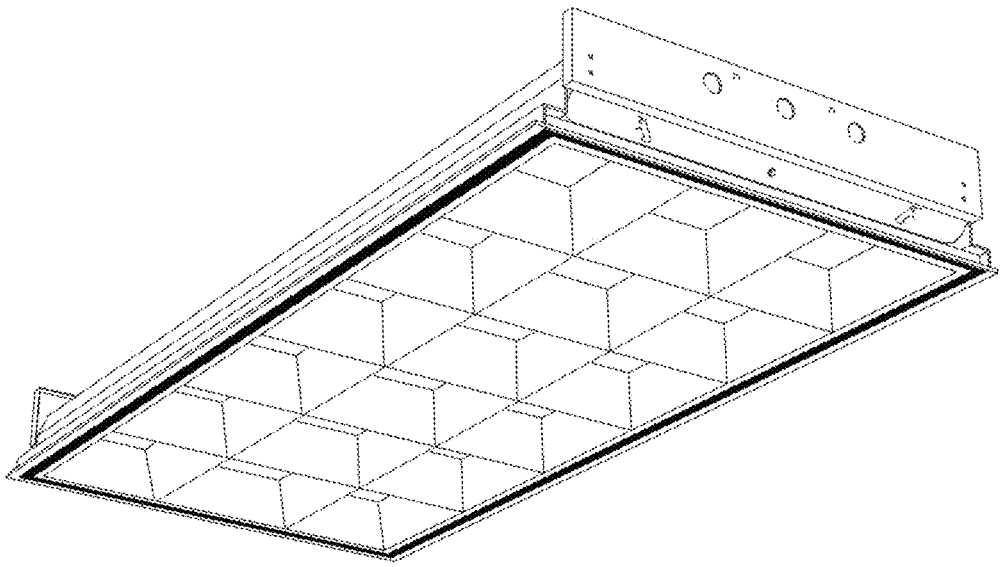
FIG. 3 PRIOR ART
FIG. 3 is an isometric view of a parabolic fluorescent fixture as known in the prior art.
Figure 4:
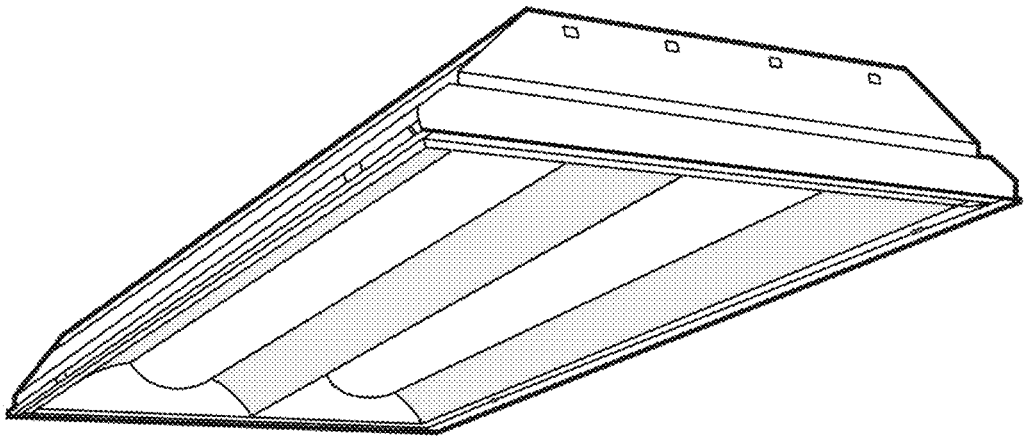
FIG. 4 PRIOR ART
FIG. 4 is an isometric view of a volumetric fluorescent fixture as known in the prior art.
Figure 5:
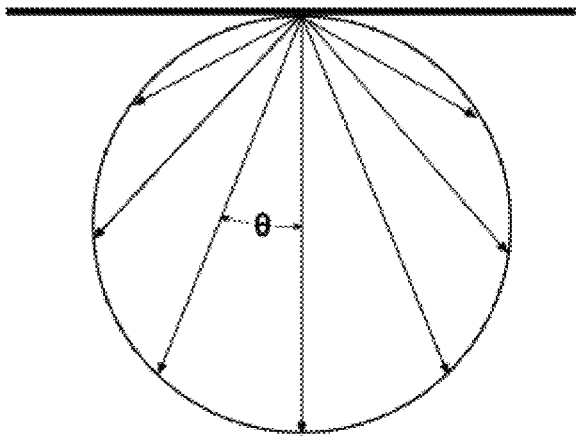
FIG. 5 PRIOR ART
FIG. 5 is a schematic view of a Lambertian light distribution as known in the prior art.
Figure 6:
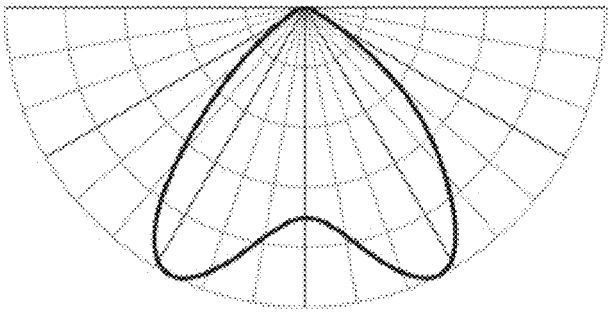
FIG. 6 PRIOR ART
FIG. 6 is a schematic view of a bat wing light distribution as known in the prior art.
Figure 10:
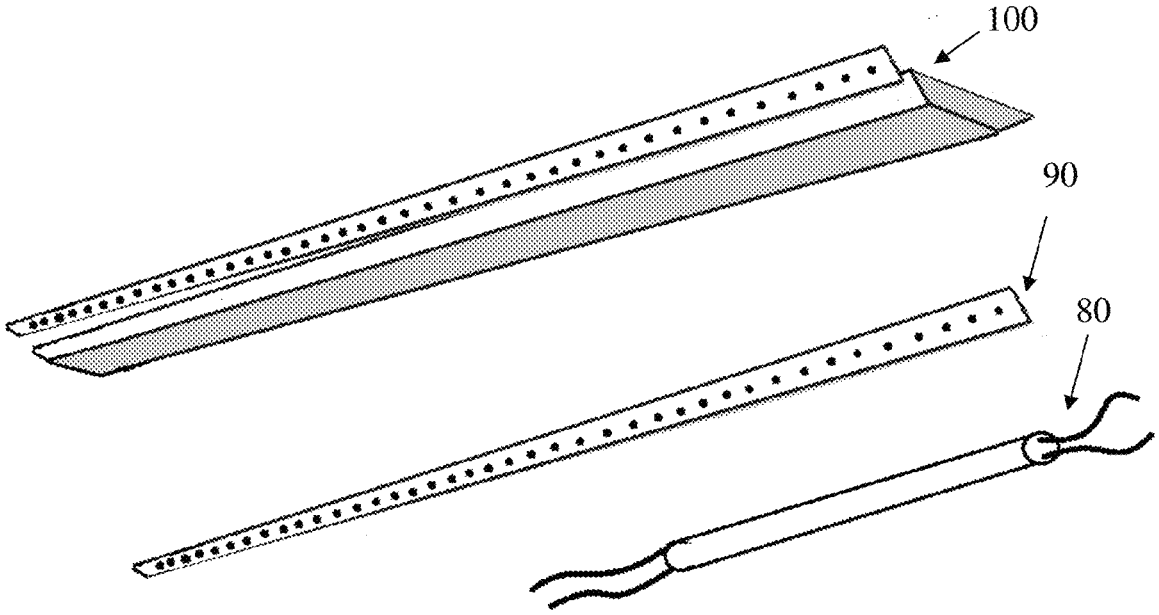
FIG. 10 is an exploded view of one exemplary embodiment of an LED module and related components.

FIG. 10 illustrates one exemplary embodiment of an LED module 100 and components related to the same. In the illustrated embodiment the related components include an LED driver 80 and a printed circuit board (PCB) 90. The LED module 100 can be mounted on the PCB 90 and the driver 80 can be used to power the LED module 100. The LED driver 80 can be located in any number of locations internal to or external of the LED module 100, including within the LED module 100, within a panel, such as the panel 08 of FIGS. 7A and 7B, adjacent to a panel, or remote from both the LED module and the panel. In embodiments in which the LED module is placed over a troffer, such as the troffers shown in FIGS. 2, 3, and 4, the driver can be placed inside of the existing fluorescent troffer. In some instances in which the driver is placed inside the LED module, the resulting component can be compact and simple as a result, thereby allowing an installer to take the finished LED panel and wire it directly to the line power without having to separately account for the driver. In some instances, however, it may be more preferable to separate the driver from the LED module, for example due to regulatory requirements, heat management, or weight or physical dimensional constraints. In instances in which the driver is disposed in a fluorescent troffer, the troffer can act as a junction box for the conduit to enter into the fixture and connections can be made in the sturdy, existing metal fixture enclosure surrounding the ballast and wiring of the light structure. Relying on an existing object like the troffer to act as the junction box can be helpful in reducing additional weight or forces applied to an installed thin panel or ceiling tile with which the LED module is associated because it means a junction box or like components are not separately associated with the panel or ceiling tile. The LED module 100 can simply be an extruded/injection molded or thermoformed part which LEDs are mounted on, and the LEDs can be mounted on or slid onto the PCB 90. A person skilled in the art will recognize that the LED module 100 can contain a number of features, including but not limited to optics, reflectors, and diffusers, which can help create the proper beam angles.

Figure 11:
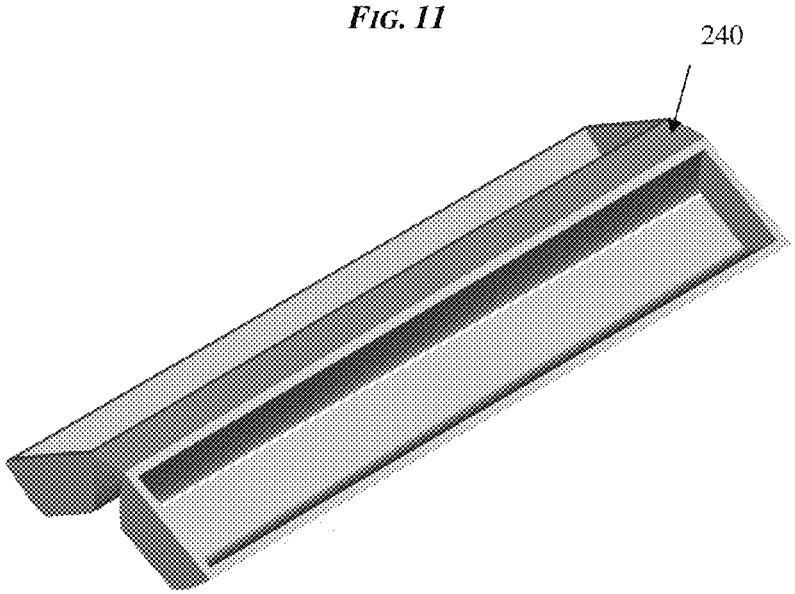
FIG. 11 is an isometric view of an exemplary embodiment of a linear optical body for inclusion as part of an LED module.

One exemplary embodiment of a linear optical body or cavity for incorporation into an LED module that can be used in accordance with the disclosures herein is shown in FIG. 11. Alternatively, the linear optical body or cavity can also be used in conjunction with other LED modules not necessarily described herein without departing from the spirit of the present disclosure. This linear optical body 240 can be the host to a circuit board with LEDs mounted thereto, as described in further detail below. The linear optical body 240 is configured such that it provides a distribution of light in desired configurations, such as a bat wing distribution, without the assistance of a secondary optics component. The linear optical body 240 can be manufactured out of a variety of materials known to those skilled in the art, including but not limited to paper, metal, metal alloys, polymers, and plastic. Further, the body 240 can have a variety of shapes, as described in greater detail below, with the shapes being able to be formed using any number of methods and processes known to those skilled in the art, including but not limited to extrusion, bending, and thermoforming. Accordingly, a person skilled in the art will recognize that although the embodiments described herein generally discuss the shapes associated with the body 240 being complex parabolic bodies, other shapes can be used to create desired light distributions without relying upon secondary optics components to help control the resulting light distributions and without departing from the spirit of the present disclosure. Additionally, desired light distributions are not limited to bat wing configurations. In view of the disclosures herein, a person skilled in the art will recognize that the choices of placement of the LEDs and the curvature and sizes of the walls of the optical body can depend on a number of factors, including but not limited to the desired light distribution, glare, and uses of the light source, and that by adjusting the location of the LEDs and the sizes and shapes of the walls of the optical body, different light distributions can be created.

Figure 12A:
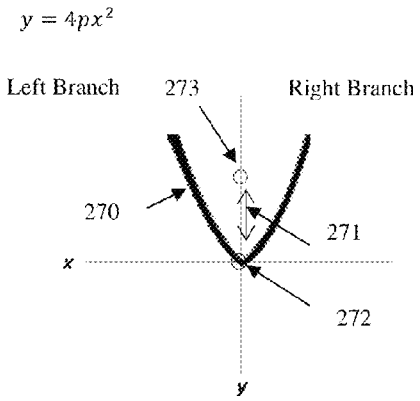
FIGS. 12A-12D are schematic diagrams illustrating one exemplary embodiment for forming a linear optical body having complex parabolic surfaces for use in conjunction with an LED module.
Figure 12B:
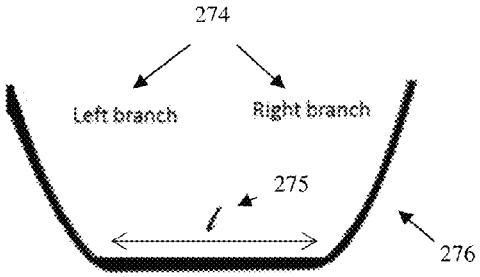
Figure 12C:
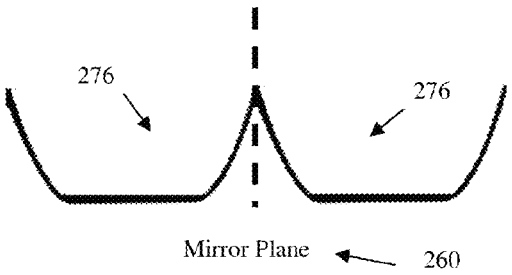
Figure 12D:
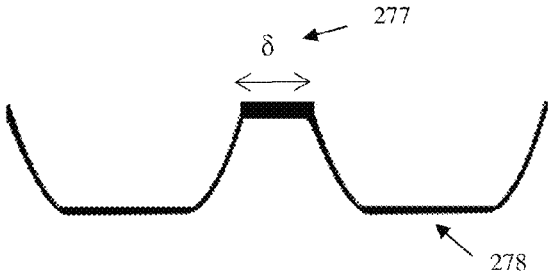
Figure 12E:
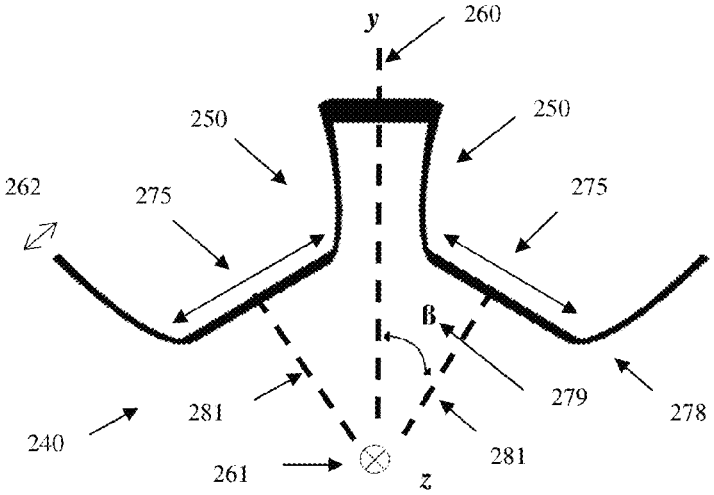
FIG. 12E is a schematic diagram of a side profile of the linear optical body of FIG. 11, which results from a process associated with FIGS. 12A-12D.

FIGS. 12A-12D illustrate one way by which a linear optical body can be formed for use in conjunction with the LED modules disclosed herein, as well as other LED modules known to those skilled in the art, while FIG. 12E illustrates the configuration that results from the steps associated with FIGS. 12A-12D, which incidentally is the optical body 240 of FIG. 11. In the illustrated embodiments, end caps of the body are removed to more clearly illustrate different parts of its construction. As shown in FIGS. 12D and 12E, the linear optical cavity 240 can include two extruded complex parabolic bodies 278 that have been rotated at an angle β 279 (FIG. 12E) from one another.

FIG. 12A illustrates a parabolic shape that is prescribed by the mathematical relation of a parabola, $y=4px^2$ where, as shown, p 271 is the distance from the vertex 272 to the focal point 273 of the parabola 270 and x and y are the abscissa and ordinate of an XY Cartesian plane. As shown, the parabola 270 has a left branch and a right branch. Turning to FIG. 12B, the left and right branches of the parabolic sidewalls 270 are separated when the two branches 274 of the parabola are disconnected at the vertex 272, separated and connected by a linear or curved line at a distance l 275. The geometrical shape that results is a complex parabola 276. As illustrated in FIG. 12C, the complex parabola 276 can be duplicated at one of the branches across a mirror plane 260, thus resulting in a second complex parabola. The mirror plane can be a central axis of the linear optical body, as shown in FIG. 12E. FIG. 12D illustrates these two complex parabolas in a displaced form, as shown complex parabolas 278, configured in a manner such that they are displaced from each other a distance δ 277. The two parabolas are connected by a linear or curved line, as shown a linear line, and thus a length of the line is also δ 277.

As illustrated in FIG. 12E, the two complex parabolas 278 can be rotated at an angle β 279 around the z-axis, which is perpendicular to the XY axis, such that the two straight lines 275 of the complex parabolas 278 are coplanar but not collinear (the complex parabolas are subscript in the XY plane). In the illustrate embodiment the two displaced complex parabolas 278 are rotated at an angle β=45°, as illustrated by central or extrusion axes 281 of the first and second complex parabolas 278. A person skilled in the art will recognize that other angles β of rotation are possible, including but not limited to angles approximately in the range of about 15° to about 60°, and that such angles can be selected to assist in creating different light distributions. Once these two extended complex parabolas 278 are extruded along the z-axis 261 perpendicular of the XY plane, a surface of the extruded, extended complex parabolas 278 is formed, resulting in the complex parabolas 278 actually being complex parabolic surfaces 278. Further, a thickness 262 can be added to the extrusion. In such embodiments a solid, three-dimensional object (linear optical cavity) 240 can be formed.

A person skilled in the art will recognize that the 3-dimensional extruded optical cavity 240 can be made from a variety of materials using a variety of different techniques, including but not limited to a polymer or plastic extrusion, thermal forming of a polymer or plastic, folding and other manipulation of a paper box, metal or metal alloy bending, and metal or metal alloy forming. Further, as described herein, a person skilled in the art will recognize that the complex parabolas 276, 278 are used to demonstrate one of many possible shapes for linear optical bodies to be used in conjunction with the present disclosures. As described herein, a complex parabolic body is an elongate body having a complex parabolic shape, deviating to the extent as shown in illustrations for purposes of forming bottom surfaces of the body (illustrated by lines 275 in FIG. 12E) and/or for allowing one or more circuit boards, LEDs, and/or other features to be mounted thereto.

Figure 13:
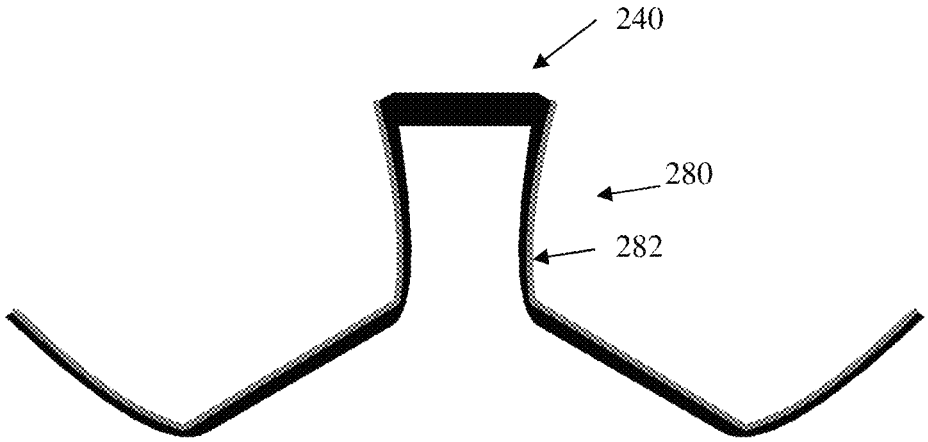
FIG. 13 is a side profile view of the linear optical body of FIG. 11, the body having an inner reflective surface.

FIG. 13 illustrates the linear optical body 240 having an inner reflective surface located on inner walls or cavities 280. The inner reflective surface can be created in a variety of ways, for instance by including on the inner walls 280 a highly reflected mirror finish, but in the illustrated embodiment a highly reflective white diffuser 282 is coupled to the inner walls to provide the desired inner reflection. In one exemplary embodiment the reflectivity of the diffuser 282, or another reflective component incorporated therein, is approximately equal to or greater than about 95%. High reflectivity values can allow for desired light distributions to be achieved, such as a bat wing light distribution. In some embodiments the reflector can be a coating applied to the inner walls 280, a coating sprayed on to the inner walls 280, a film applied to the inner walls 280, or a sheet that has been thermoformed or extruded and then applied to the inner walls 280. Further, a light source can be incorporated into the linear optical body 240. While the light sources can be incorporated in a number of different manners, in one exemplary embodiment a set of LED packages can be placed along the extrusion axis of the complex parabolic reflector.

Figure 14:
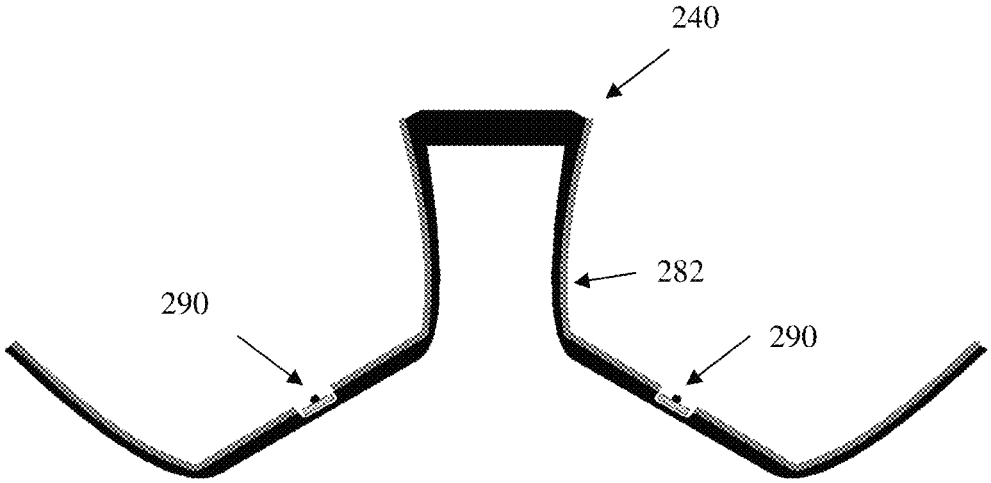
FIG. 14 is a side profile view the linear optical body of FIG. 13, the body having a linear LED light source associated therewith.

FIG. 14 illustrates the linear optical body 240 having a linear LED light source 290 associated therewith. As shown, the linear optical body 240 includes an inner reflective surface in the form of the diffuser 282, and the light source 290 includes a circuit board having LEDs mounted thereto. The light source 290 can be associated with the body 240 using a variety of techniques known to those skilled in the art. In the illustrated embodiment, the body 240 is modified to include a channel for receiving the light source 290, with the channel having a depth that allows the diffuser 282 to sit flush with the top of the circuit board. This can be advantageous because it can allow for the greatest amount of internal space to be covered by the diffuser 282. Although the illustrated embodiment includes two light sources 290, any number of light sources can be mixed and matched with other light sources, inner reflective surfaces, and other components within the spirit of the present disclosure to create different light distribution effects. As shown, no secondary optics components, including but not limited to lenses, are provided. The present configuration allows for broad-ranging light distributions without using secondary optics components. However, secondary optics components can be included in some embodiments if desired. To the extent secondary optics components are included, they can be designed such that they do not have a significant impact on the light distribution provided by the light source. Alternatively, secondary optics components can be included and can provide a further variable relied upon for controlling light distribution.

FIGS. 15A-20B illustrate a number of different examples of locations for light sources to be associated with linear optical bodies in accordance with the disclosures herein. More particularly, for each numbered figure, the FIG. A illustration shows a side profile view of the optical body and associated light source and the FIG. B illustration shows a light distribution that results from the configuration illustrated in FIG. A. In accordance with the disclosures herein, the light distribution that results from the configurations provided depend on a number of factors, including a size of the complex parabolic shape that forms the body and the positioning of the light source, as shown LEDs, with respect to the complex parabolic body. As demonstrated by the teachings herein, there is in fact a unique correlation between the rotated angle of the complex parabolic body and the LED linear positioning along the extrusion axis of the complex parabolic body that allows for a bat wing candela distribution to be created. Other desirable types of light distributions can also be achieved. In each of the examples shown in FIGS. 15A-19B, the collinear extruded complex parabolic body 240' is rotated at approximately 45°, although other shapes and angles of rotation can be used in other configurations without department from the spirit of the present disclosure. In each embodiment, the LED placement is illustrated using LED 290', and the resulting light distribution is illustrated in the diagram 300'. The horizontal dotted line 302' on the plots corresponds to a ceiling of a fixture. If the linear light source is placed in a fixture, then the candela above the horizontal dotted line means that part of the light will illuminate the ceiling or top of the fixture. All of the resulting light distributions may be desirable for different types of lighting environments or purposes.

Figure 15A:
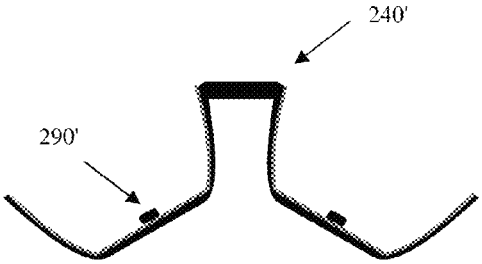
FIG. 15A is a side profile view of one exemplary embodiment of a linear optical body illustrating one possible location for an LED light source.
Figure 15B:
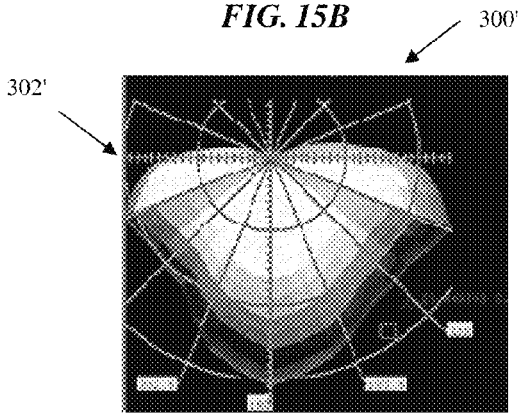
FIG. 15B is a schematic diagram illustrating a light distribution resulting from the configuration of the linear optical body of FIG. 15A.

FIG. 15A illustrates the LEDs 290' at locations that are equidistant on the respective base of each complex parabolic body 240'. This resulting light distribution shown in FIG. 15B can be described generally as a wide bat wing configuration combined with a central high intensity cone of light.

Figure 16A:
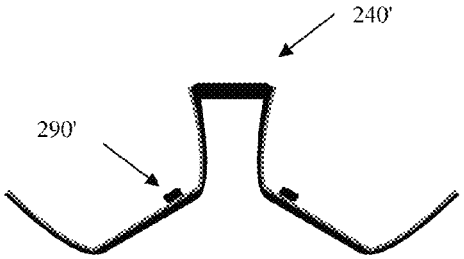
FIG. 16A is a side profile view of another exemplary embodiment of a linear optical body illustrating another possible location for an LED light source.
Figure 16B:
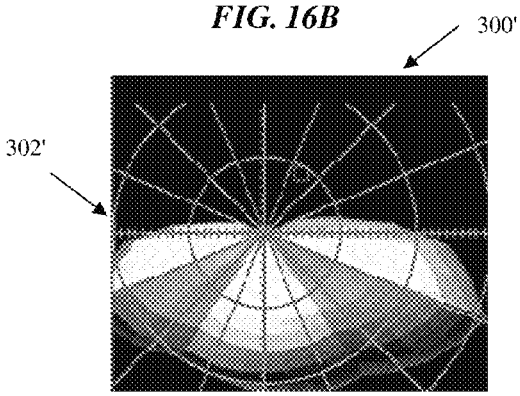
FIG. 16B is a schematic diagram illustrating a light distribution resulting from the configuration of the linear optical body of FIG. 16A.

FIG. 16A illustrates the LEDs 290' at locations towards an inside wall on the base of each complex parabolic body 240'. This resulting light distribution shown in FIG. 16B can be described generally as a wide bat wing configuration combined with a slight central high intensity cone of light.

Figure 17A:
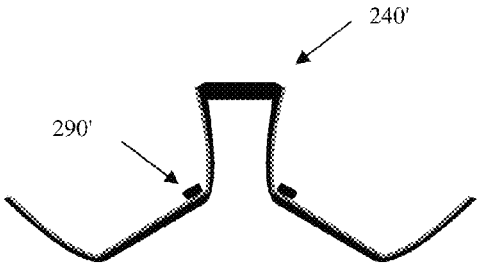
FIG. 17A is a side profile view of yet another exemplary embodiment of a linear optical body illustrating yet another possible location for an LED light source.
Figure 17B:
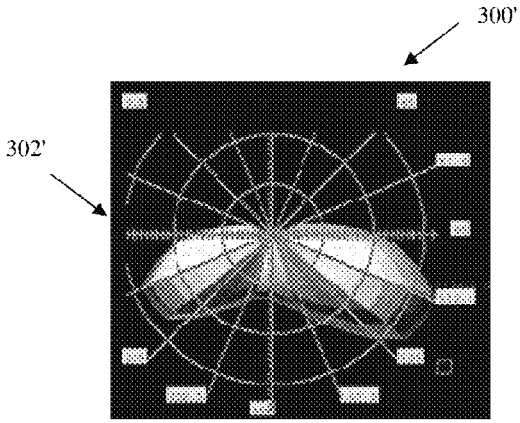
FIG. 17B is a schematic diagram illustrating a light distribution resulting from the configuration of the linear optical body of FIG. 17A.

FIG. 17A illustrates the LEDs 290' at locations proximate to the inside wall on the base of each complex parabolic body 240'. This resulting light distribution shown in FIG. 16B can be described generally as a very wide bat wing configuration.

Figure 18A:
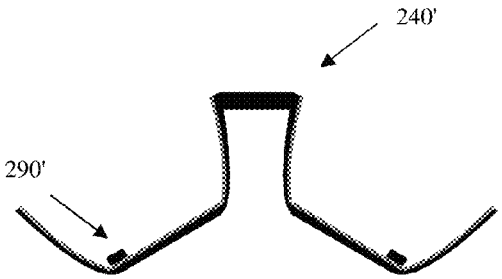
FIG. 18A is a side profile view of still another exemplary embodiment of a linear optical body illustrating still another possible location for an LED light source.
Figure 18B:
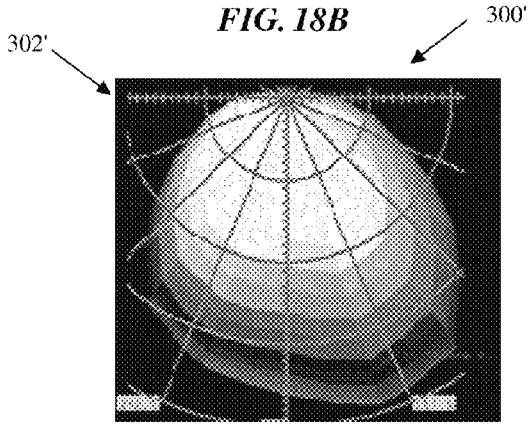
FIG. 18B is a schematic diagram illustrating a light distribution resulting from the configuration of the linear optical body of FIG. 18A.

FIG. 18A illustrates the LEDs 290' at locations towards an outside wall on the base of each complex parabolic body 240'. This resulting light distribution shown in FIG. 18B can be described generally as a uniform Lambertian pattern.

Figure 19A:
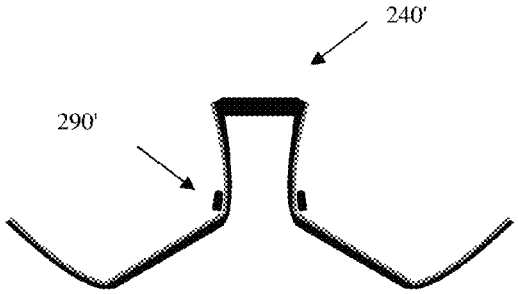
FIG. 19A is a side profile view of another exemplary embodiment of a linear optical body illustrating another possible location for an LED light source.
Figure 19B:
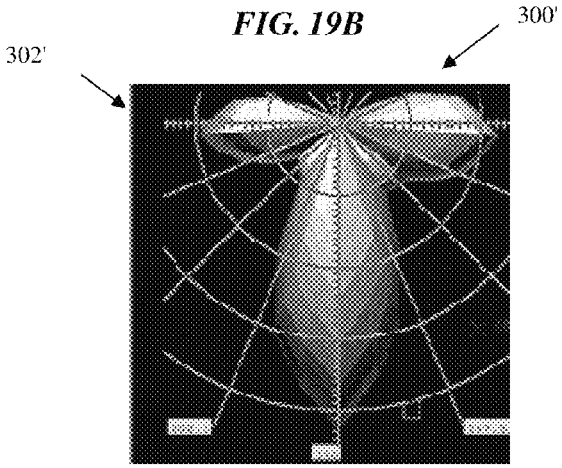
FIG. 19B is a schematic diagram illustrating a light distribution resulting from the configuration of the linear optical body of FIG. 19A.

FIG. 19A illustrates the LEDs 290' at locations on an inside curved wall pointing inwards towards an outside curved wall of each complex parabolic body 240'. This resulting light distribution shown in FIG. 19B can be described generally as two lobes of light with some upwards illumination combined with a sharp central high intensity cone of light.

Figure 20A:
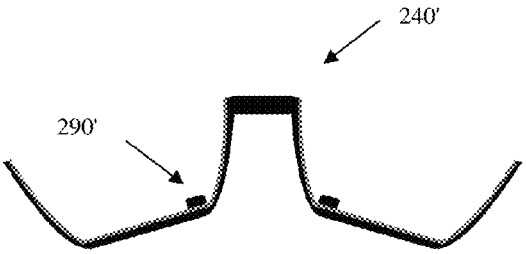
FIG. 20A is a side profile view of yet another exemplary embodiment of a linear optical body illustrating yet another possible location for an LED light source.
Figure 20B:
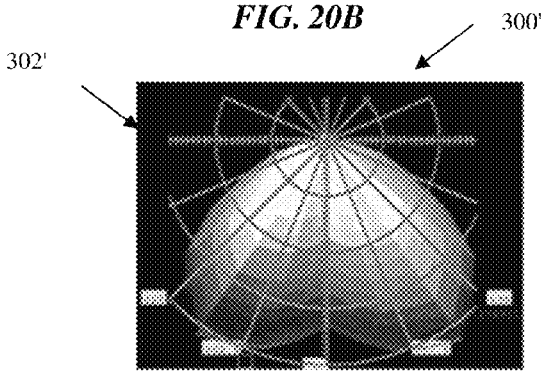
FIG. 20B is a schematic diagram illustrating a light distribution resulting from the configuration of the linear optical body of FIG. 20A.

FIG. 20A illustrates the LEDs 290' at locations towards the inside wall on the base of each complex parabolic body 240' now rotated at an angle of $\beta=30°$. This resulting light distribution shown in FIG. 20B can be described generally as a bat wing configuration, with no central cone of light, which can result in low glare levels directly under the module. The distribution using a complex parabolic body rotated at approximately 30° can be useful in contexts such office space illumination.

Figure 21:
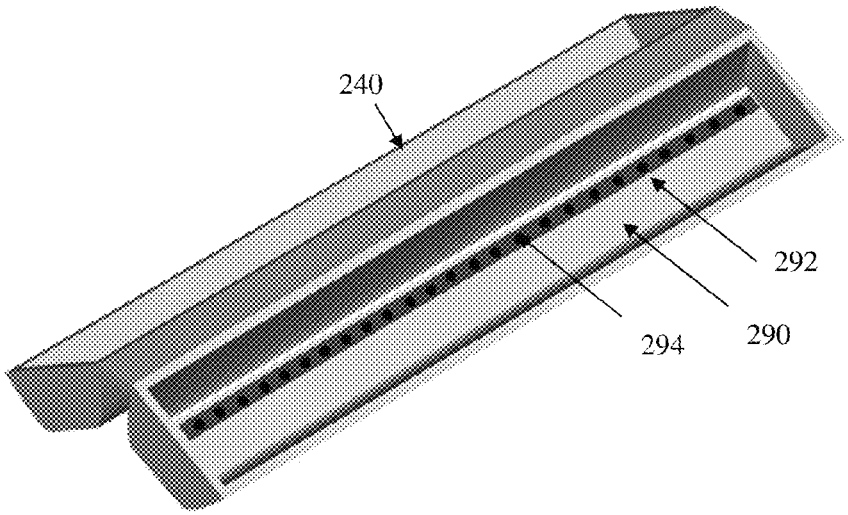
FIG. 21 is an isometric view of the linear optical body of FIG. 11 having the linear LED light source of FIG. 14 mounted thereto.

FIG. 21 illustrates the linear optical body 240 associated with the light source 290. The light source 290 can include a circuit board 292 and a plurality of LEDs 294 mounted thereto. In the illustrated embodiment, the light source 290 is mounted to the body 240 in the same orientation as shown in FIG. 20A, and thus in the LEDs 294 are positioned off-center, loaded towards an inner side of the inner surface of the parabolic shape of the body 240, and the complex parabolic shapes of the body 240 are rotated at approximately a 30° angle. This is configuration can be useful as an LED module incorporated into a panel or ceiling tile for use in a fluorescent troffer retrofit, replacement, or new installation, as described in further detail below.

Figure 22A:
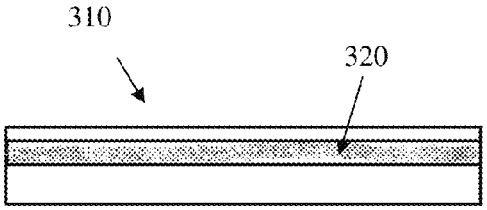
FIG. 22A is a side profile view of one exemplary embodiment of a glare reduction lens.
Figure 22B:
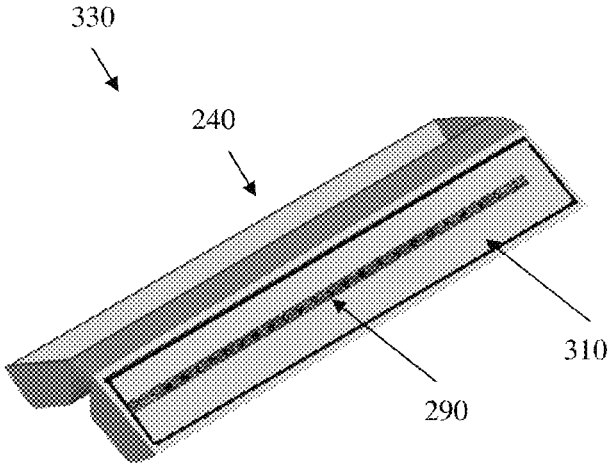
FIG. 22B is an isometric view of the linear optical body of FIG. 21 having the glare reduction lens of FIG. 22A incorporated therewith, the configuration resulting in an exemplary embodiment of an LED module.

FIGS. 22A and 22B are directed to a glare reduction lens. In particular, FIG. 22A illustrates one exemplary embodiment of a glare reduction lens 310 and FIG. 22B illustrates one exemplary embodiment of the lens 310 being incorporated into the linear optical body 240 and with the light source 290 to form an LED module 330. The glare reduction lens 310 can serve at least two purposes. First, it can serve as a protective cover over the inner cavity of the LED module formed by the body 240 and light source 290. In some instances the inner cavity 240 may need to be covered to meet regulatory requirements (such as Underwriters Laboratories, or UL) because there can be live circuitry inside the cavity, and to serve as a protective cover of the inner cavity 240 so that a reflective cavity associated therewith does not accumulate dust, get wet, or otherwise get dirty, thereby keeping the high reflectance of the inner cavity 240. Second, the glare reduction lens 310 can be slightly frosted or diffused either in its entirety or only in the area 320 (FIG. 22A) where the LEDs of the light source 290 are placed under it. As a result, it can serve to reduce glare because the LED sources will be less evident. It can be desirable to only diffuse the portion of the lens 310 where the LEDs of the light source 290 are located under it so as to not unnecessarily reduce the optical efficiency of the LED light source. In the illustrated embodiment, the glare reduction lens 310 does not substantially affect the light distribution emanating from the light source 290. Thus, although the glare reduction lens 310 is an example of a secondary optics component, the light distribution from the light source 290 is not the result of passing light through a secondary optics component.

This lens 310 can be applied to the top surface of the optical body 240 as shown using any number of techniques known to those skilled in the art. By way of non-limiting examples, the lens can slide, press, clip or be glued in place with respect to the body 240. In some embodiments, the lens can serve a decorative purpose. For example, it can be tinted a particular color(s). A person skilled in the art will recognize that the combination of the body 240 and the light source 290 can form an LED module for use in the various systems, kits, and methods described herein pertaining to retrofit and new light fixture installation. Likewise, the additional features described herein, including but not limited to the lens 310, an inner reflective surface such as the diffuser 282, and covers, electronics, and wiring as needed, can be incorporated into such LED modules. Such LED modules can be associated with panels and ceiling tiles as described herein.

Figure 23:
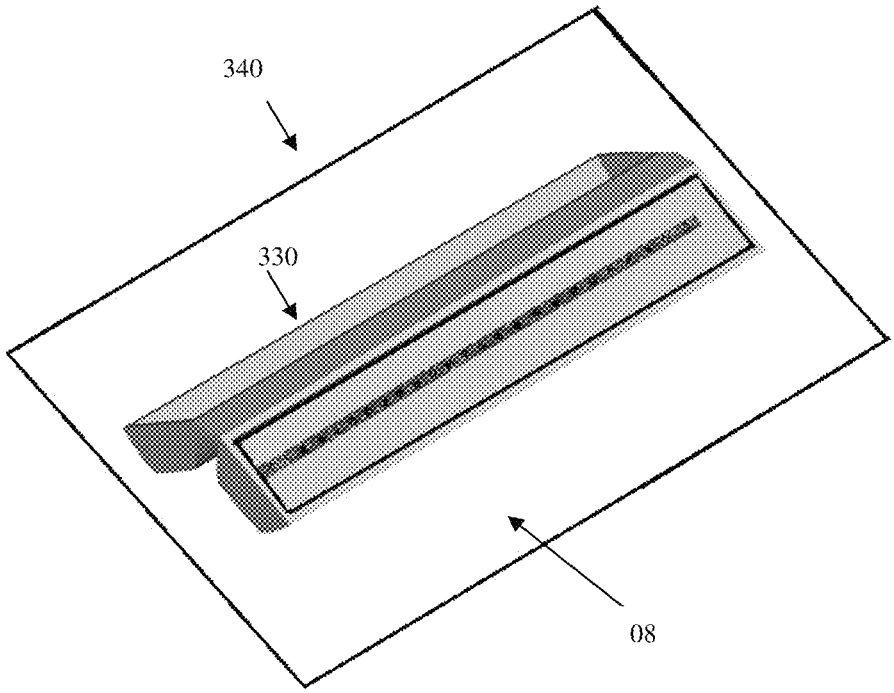
FIG. 23 is an schematic isometric view of the LED module of FIG. 22B integrated with the thin panel of FIGS. 7A and 7B to form an LED panel.

One illustration of the LED module 330 incorporated with the thin panel 08 to form an LED panel 340 is shown in FIG. 23. The association between the LED module 330 and the thin panel 08 can be created in any number of ways, including using techniques described herein. A person skilled in the art will recognize that the LED module 330 can also be incorporated with the ceiling tile 09 if desired to form a panel like the LED panel 120.

Figure 24:
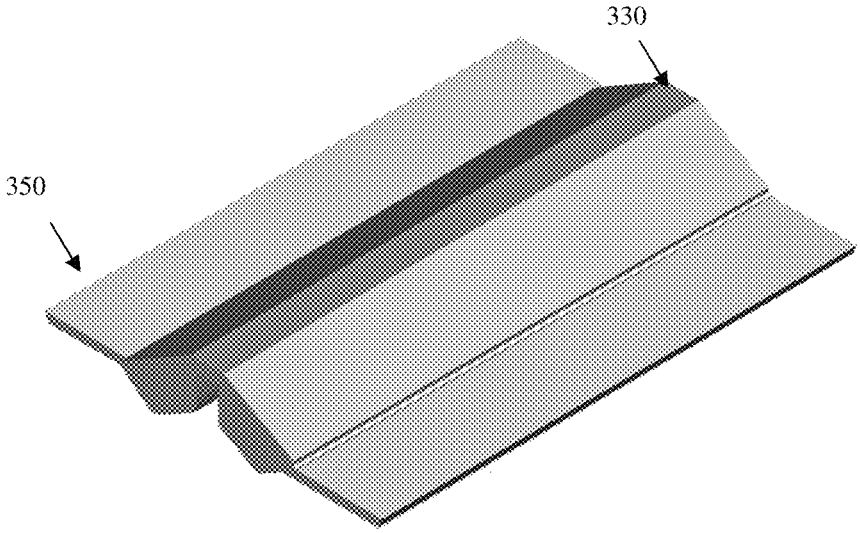
FIG. 24 is an isometric view of the LED module of FIG. 22B having fins incorporated therewith.

FIG. 24 illustrates the LED module 330 having fins incorporated therewith. The fins 350 can be incorporated with the LED module 330 using a variety of techniques, but in one embodiment the fins 350 are extruded when the linear optical body or cavity is extruded, i.e., the entire assembly can be a single extrusion. The fins 350 serve can provide utility, and can also be configured to add a decorative feature to the LED module 330. The fins 350 can be useful because they can act as cut-offs for light emitting from the LED module, for instance if further control of the light distribution is desired. The fins 350 can be set to different angles to achieve different variations of cut-off. The fins 350 can designed to be decorative, for instance, by selecting a desired size, shape, and/or material, by painting them, and/or by laminating them. A person skilled in the art will recognize a number of different ways by which the look of the fins 350, and thus the module 330, can be enhanced. In one exemplary embodiment the fins 350 are made from brushed aluminum vinyl, while in another exemplary embodiment a wood laminate can be applied to the fins 350.

Figure 25:
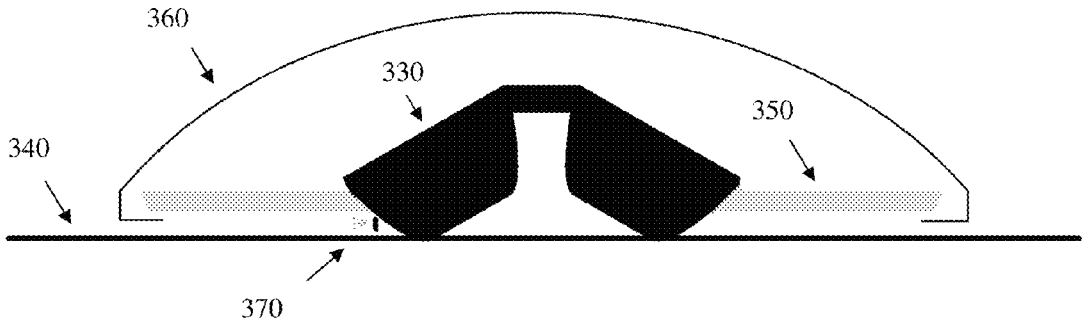
FIG. 25 is a partially transparent isometric view of the LED module of FIG. 24 incorporated with a thin panel.

FIG. 25 illustrates a side view of the LED module 330 with fins 350 and including an accessory mount or cover 360 mounted to the panel 08. In the illustrated embodiment the accessory cover extends above the LED module 360, and thus above the module's linear optical body. Similar to the fins 350, the accessory cover 360 can be both decorative and useful. As shown, the cover 360 can be mounted to the LED module by attaching to the fins 350. The attachment can be made using any number of techniques known to those skilled in the art, including by relying upon a mechanical fit or an adhesive. The accessory cover 360 can assist to help further reduce glare and/or control the light distribution of the LED module 330. The cover 360 can be made from a variety of materials, including but not limited to diffused material or perforated material such as a screen or baffling. In some embodiments, sideways emitting LEDs 370 can be mounted such that they are recessed under the fins 350 to illuminate some of the top side of the panel 340. Like any of the light sources disclosed herein, the illumination can any number of colors, but in one exemplary embodiment the color from the LEDs 370 is white. In some embodiments, the illumination provided by the LEDs 370 may only require a very small amount of electrical power, and thus can be used, by way of non-limiting example, as emergency lighting. That is, when the power goes out, the LEDs 370 of the module 330 can be powered by a battery to provide emergency lighting for the occupants of the space.

Figure 26:
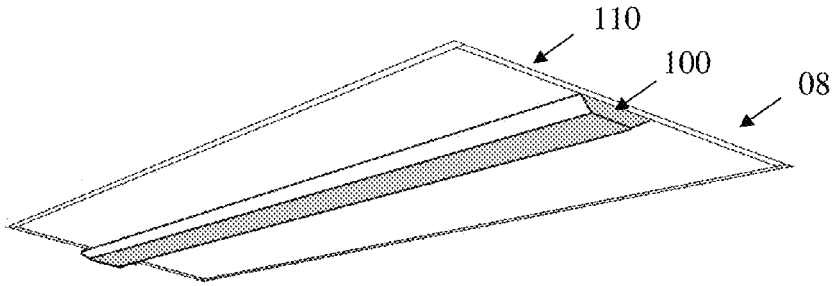
FIG. 26 is an isometric view of the LED module of FIG. 10 integrated with the thin panel of FIGS. 7A and 7B to form an LED panel.

FIG. 26 illustrates one exemplary embodiment of an LED module integrated into a thin panel or ceiling tile. In particular, the LED module 100 is shown as being integrated into the panel 08 of FIGS. 7A and 7B. The LED module 100 can be integrated with the panel 08 using any number of techniques known to those skilled in the art, including by way of an adhesive or mechanical attachment such as taping or ultrasonic welding. The entire assembly can be described as an LED panel 110. A person skilled in the art will recognize that other LED modules, including those of the nature disclosed herein, such as the LED module 330 of FIGS. 23-25, can be attached to the panel 08 to form an LED panel like the LED panel 110.

Figure 27:
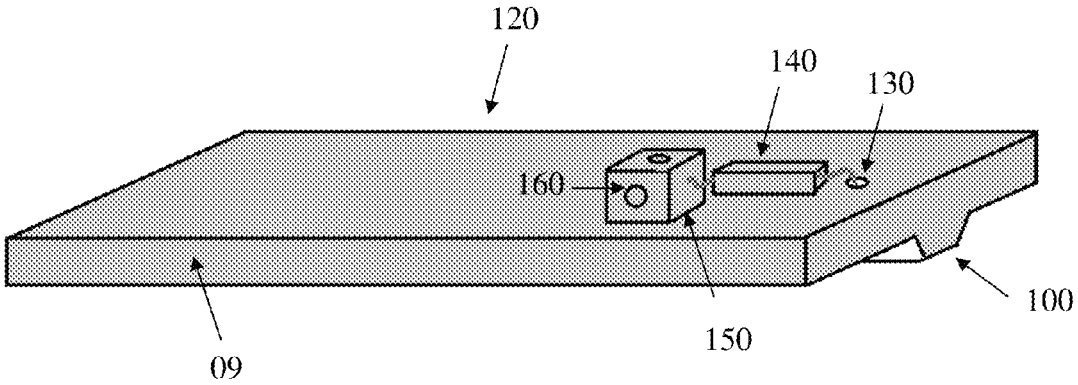
FIG. 27 is an isometric view of the LED module of FIG. 10 integrated with a ceiling tile to form an LED panel.

Although in FIG. 26 the component integrated with the LED module 100 is the thin panel 08, a ceiling tile can be used in place of the thin panel 08. One exemplary embodiment of such a configuration is shown in FIG. 27. As shown, the LED module 100 is integrated into a ceiling tile 09 on a front face of the tile 09 to form an LED panel 120. The ceiling tile 09 can be any type of commercially available ceiling tile, such as tiles manufactured by companies like Armstrong or USG. A person skilled in the art would understand a number of different sizes, shapes, and types of ceiling tiles with which LED modules of the nature described herein can be associated without departing from the spirit of the disclosure. For example, a size of the ceiling tile 09 may be approximately 2 feet by approximately 4 feet, which is a common size for ceiling tiles. A thickness of the panel can be thin, for instance in the range of about 1 inch to about 5 inches thick, and in one embodiment it is about 3 inches thick. The LED module 100 can be integrated with the ceiling tile 09 using any number of techniques known to those skilled in the art, including by way of an adhesive or mechanical attachment such as taping or ultrasonic welding. A person skilled in the art will recognize that other LED modules, including those of the nature disclosed herein, such as the LED module 330 of FIGS. 23-25, can be attached to the ceiling tile 09 to form an LED panel like the LED panel 120.

In some embodiments it may be desirable to provide additional support for the ceiling tile 09, for instance to account for any structural strength compromised by virtue of coupling the LED module 100 to the ceiling tile 09. For example, in instances in which a slot or other cut is formed in the tile 09 to assist in integrating the LED module 100 with the tile 09. The use of slots or cuts, however, does not necessarily compromise the structural strength of a ceiling tile 09, or a panel 08 for that matter. A number of techniques known to those skilled in the art for providing additional strength include providing reinforcement bars or plates to the backside of the tile 09.

In the configuration shown in FIG. 27, additional components of the lighting system include an LED driver 140 and a junction box 150. As shown, the LED driver 140 and the junction box 150 are attached to the backside of the tile 09. A person skilled in the art will recognize that it may be possible to secure the driver 140 and/or the junction box 150 to the tile 09. In the illustrated embodiment the driver 140 and the junction box 150 are located proximate to a back face of the tile 09, and the electrical connections between the LED module 100 and the driver 140 and junction box 150 are made through a hole 130 formed in the tile. As also shown, the conduit can be brought into the junction box 150 through a hole 160. In other embodiments, the junction box 150 can be located remotely or can have a disconnect system so that it is wired first and then attached to the tile, thereby reducing the risk of damaging the tile 09 when an installer attempts to position the conduit, for instance by strong-arming it, and clamp it into the junction box 150. Similar to the driver 80, the driver 140 can be located in any number of locations internal to or external of the LED module 100, including within the LED module 100, within the tile 09, adjacent to the tile 09, or remote from both the LED module 100 and the tile 09.

Figure 28:
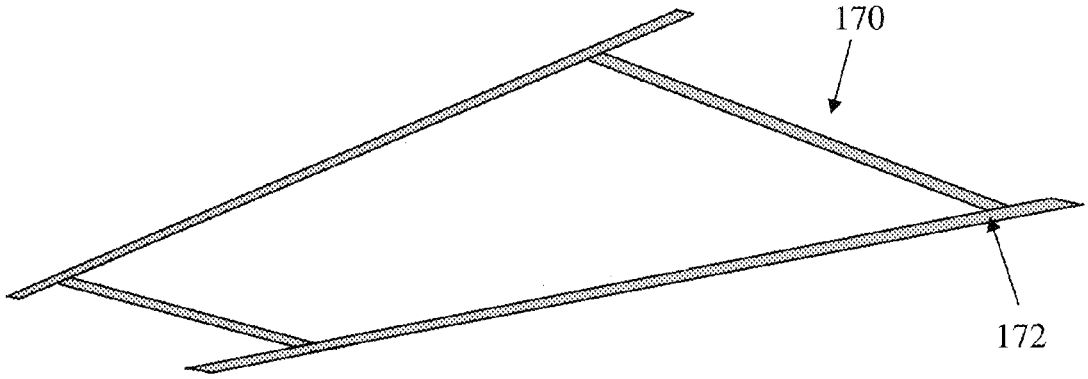
FIG. 28 is an isometric view of one rectangular section of a ceiling grid.

FIG. 28 is an illustration of one rectangular section 170 of a ceiling grid. A person skilled in the art will recognize that a ceiling grid typically includes a plurality of these rectangular sections 170. The illustrated rectangular section 170 is approximately 2 feet by approximately 4 feet, although other sizes can be used, including other common configurations, such as approximately 2 feet by approximately 2 feet, or less common configurations or spacings. A plurality of "T-bars" 172, which are generally commercially available, can be used to form the grid. The T-bars 172 can either already be installed in the space or they can be installed as part of the installation of the devices and systems described herein.

Figure 29:
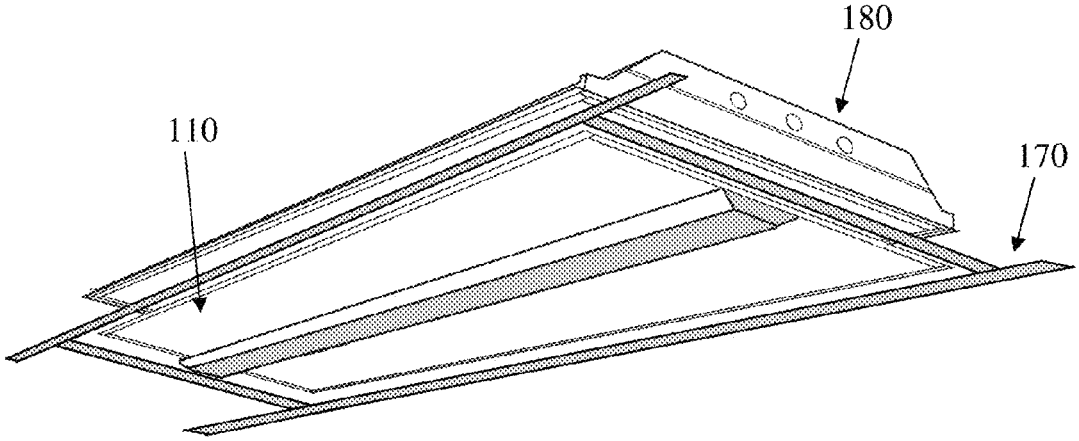
FIG. 29 is an exploded view of the one rectangular section of a ceiling grid of FIG. 28, the rectangular section having an existing fluorescent fixture, and the LED panel of FIG. 26 associated therewith.
Figure 30:
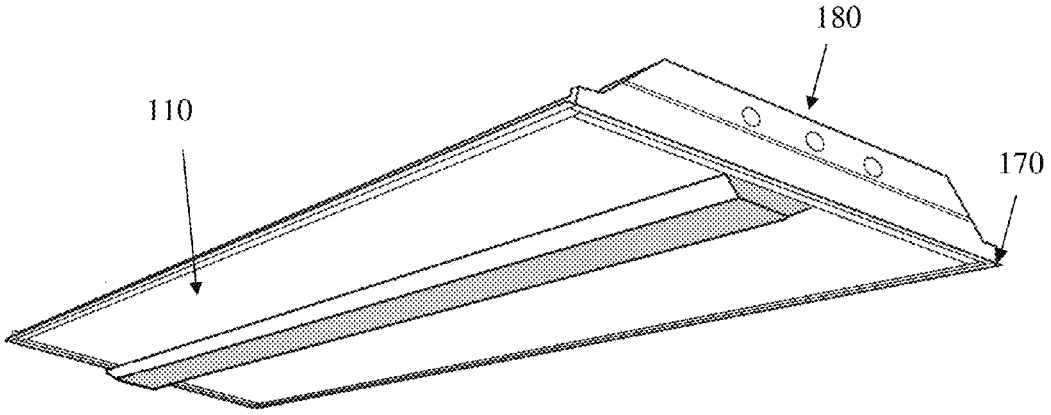
FIG. 30 is an isometric view of the one rectangular section of the ceiling grid, the fluorescent fixture, and the LED panel of FIG. 29 in an installed position.

FIGS. 29 and 30 illustrate the rectangular section 170 of a ceiling grid in conjunction with an existing fluorescent fixture 180 and the LED panel 110. These views help illustrate one non-limiting way in which components of the systems and devices provided for can be installed in a retrofit scenario. The existing fluorescent fixture 180 can be of any type, including but not limited to the types described with respect to FIGS. 2, 3, and 4, but in the illustrated embodiment the existing fluorescent fixture 180 is a prismatic troffer. In the case of an installation involving a prismatic troffer, the enclosure door of fixture 180 can be swung open, thus allowing the prismatic lens to be removed. Next, the LED panel 110 can be set in the door of the fixture 180, electrical connections between the LED panel 110 and existing electrical components can be made, and then the door can be closed to complete the installation. In the case of any of the three types of existing fixtures 180, one could also install the LED panel 110 between the ceiling grid 170 and the fixture 180. In one such manifestation of this embodiment, the installer can first the enclosure on the fixture 180 to access a ballast compartment, the installer can make the necessary electrical connections between the LED panel 110 and the other electrical components, and, if necessary, the LED driver can be mounted.

Next, the installer can push up on the fixture 180 and slide the LED panel 110 under the fixture but above the rectangular section 170 of the ceiling grid. After the LED panel 110 is aligned, the fixture 180 can be dropped back down on top of the LED panel 170. The weight of the fixture 180 resting on the LED panel 170 can help ensure the LED panel 170 does not move. In some instances, it may be easier to slide the LED panel 110 under the fixture by accessing the space, for instance by moving a ceiling tile next to the fixture 180. A person skilled in the art will recognize a number of other variations to the steps that may occur, for instance due to the particular configurations of the ceiling in which the LED panel is being installed. Such variations are within the spirit of the present disclosure.

FIG. 30 in particular helps to show the extreme low profile of the LED panel 110 with respect to the total fixture height. In fact, the height can remain virtually the same. As a result, the support cabling to the building for the existing fluorescent fixture 180 may not require any modification, such as shortening of the cables.

Figure 31:
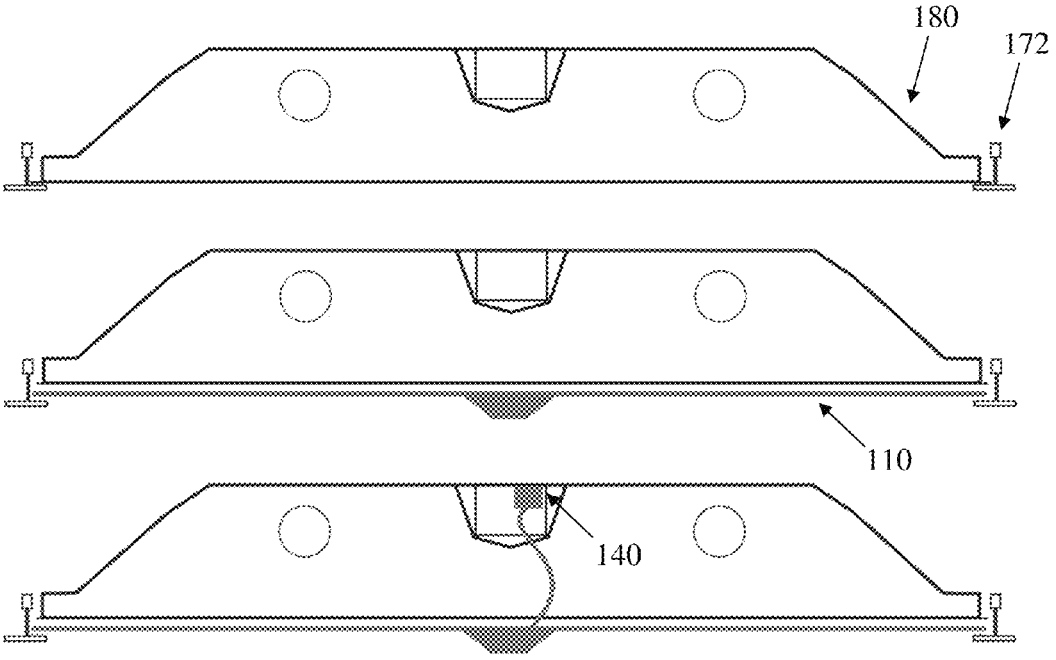
FIG. 31 is a side profile view of the one rectangular section of the ceiling grid, the existing fluorescent fixture, and the LED panel, all of FIG. 30, illustrating aspects of installation for a retrofit.

FIG. 31 helps illustrate how the installation of the panel 110 can be carried out for a retrofit. The panel 110 used in the installation can be selected based on a number of different criteria, including but not limited to a desired size based on the size of an opening with which it will be used. Thus, in the illustrated embodiment, the selected panel 110 is sized to fit an opening of the troffer of the existing fluorescent fixture 180. As shown, the fluorescent fixture 180 can already be sitting on T-bars 172 of the ceiling grid. The LED panel 110 can be placed directly between the fixture 180 and the T-bars 172. Any electrical enclosures of the troffer of the fixture 180 can be removed, thereby providing access to electrical components and connections. This can allow the troffer to serve as a junction box. Electrical connections can be made to the LED driver 140, wherever it may be located, inside of the ballast compartment on the fixture. An installer may wish to disconnect a line potential from a ballast of the troffer is electrical power is running to it. In instances in which the driver is disposed within an LED module of the LED panel 110, such electrical connections may not need to be made.

After the electrical connections are completed, one or more portions of the previously removed electrical enclosures can be re-installed to the fixture, and the LED panel 110 can be positioned at or below a bottom portion of the troffer. The resulting system is one in which a new LED module is used to provide light while leaving the entire old fixture 180 in place. A person skilled in the art will recognize a number of other variations to the steps that may occur, for instance due to the particular configurations of the ceiling in which the LED panel is being installed. Such variations are within the spirit of the present disclosure.

Figure 32:
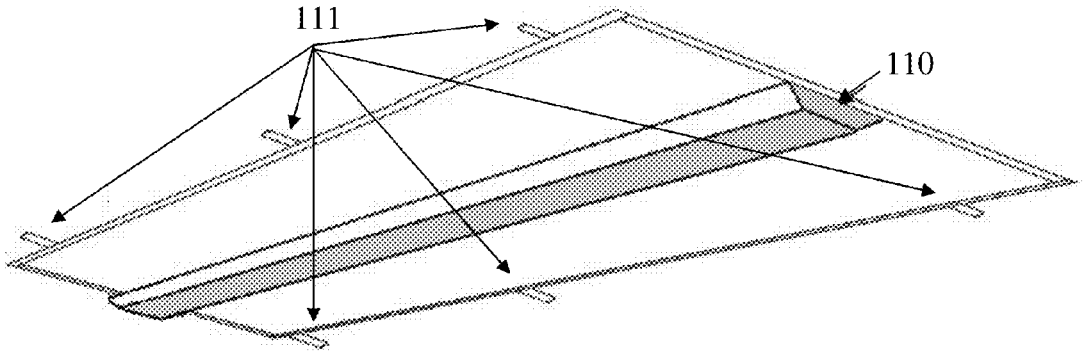
FIG. 32 is an isometric view of one exemplary embodiment of a mounting feature associated with the LED panel of FIG. 26.

One exemplary embodiment of a mounting feature for use in conjunction with installations such as those described herein, such as installations of the panel 110, is shown in FIG. 32. As shown, in some embodiments the LED panel 110 can have mounting features 111 that protrude outwards from sides of the panel 110. The protrusions can assist in making the installation of the LED panel 110 easier to install in a ceiling grid, such as the ceiling grid 170, particularly when the original fluorescent fixture being retrofitted is not perfectly seated in the ceiling. By not seating perfectly in the ceiling, additional weight is transferred onto the grid itself. The grids may not be designed to support the extra weight, particularly if the additional weight is transferred by a plurality of original fixtures. While in some retrofit scenarios there may be a small vertical gap between the fixture and the grid allowing the LED panel 110 to be slid between the two surfaces, such a configuration is not always the case. Often the existing troffer fixtures may have been installed in a way that the one or more of the fixtures is sitting directly on the ceiling gird, and thus some or all of its weight is also on the grid. In this scenario, it would be difficult to install the new LED panel 110 without some type of modification to the support cables from which the fluorescent fixtures hang. These cables can be modified, for instance by shortening them, but doing so can require the installer to open up the ceiling by removing ceiling tiles and carrying out the modification. This scenario undesirably slows down the process for installing a retrofit. The mounting features 111, however, can speed up the retrofit process.

The mounting features 111 can designed in a way that they are very thin, finger-like features that stick out transversely from the panel 110. The extreme thinness of the features 111 allow them to easily slide in between an existing fixture and the grid even in instances in which the fixture is resting directly on the grid. In some embodiments the mounting features 111 on one or both sides of the panel 110 can be configured to have a sliding or spring loaded action so that the installer can insert the features on one side of the panel first, compress the features on that side, which in turn can allow the features on the opposite side to easily be inserted.

Figure 33:
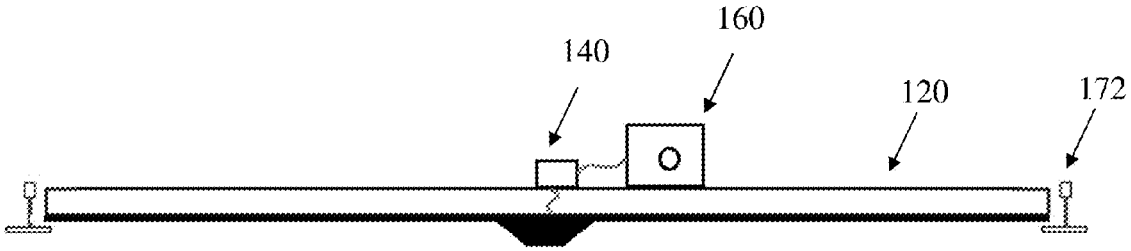
FIG. 33 is a side profile view of the one rectangular section of a ceiling grid of FIG. 16 being associated with the ceiling tile of FIG. 27 in an installed position.

FIG. 33 helps illustrate how an installation of a new LED panel, such as the panel 120, can be performed. The same ceiling grid of FIG. 31, including the T-bars 172, is shown. In this installation example, there is no existing fluorescent fixture. The LED panel 120 used in the installation can be selected based on a number of different criteria, including but not limited to a desired size based on the size of an opening with which it will be used. Thus, in the illustrated embodiment, the selected panel 120 is sized to fit an opening of the ceiling grid. The LED panel 120 can positioned in the ceiling grid at the T-bars 172 after any electrical connections are made to bring the conduit into the junction box 160 to provide power to the LED driver 140. In many embodiments, the electrical connections will be disposed adjacent to the ceiling grid, and can include a driver and/or a junction box. The selected location of the ceiling tile can depend on a variety of factors, including but not limited to where light is desired and where the location of existing electrical connections, such as junction boxes, may be. A person skilled in the art will recognize a number of other variations to the steps that may occur, for instance due to the particular configurations of the ceiling in which the LED panel is being installed. Such variations are within the spirit of the present disclosure.

Figure 34:
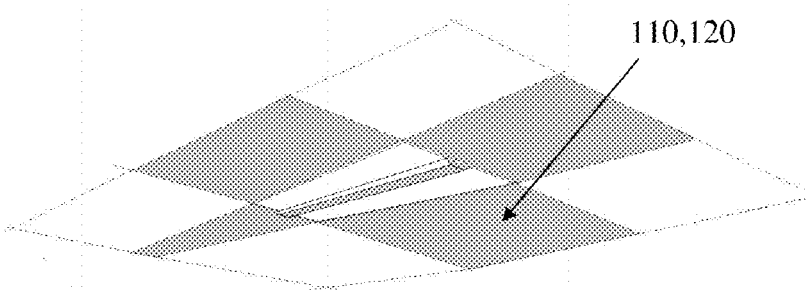
FIG. 34 is an isometric view of a ceiling grid with the thin panel and the LED module of FIG. 26 installed below an existing fluorescent fixture, or alternatively, with the ceiling tile and the LED module of FIG. 27.

FIG. 34 illustrates a ceiling grid with an LED panel 110, 120 installed. The LED panel 110, 120 can be below an existing fluorescent fixture, or it can be part of newly installed ceiling tile. The resulting installation is a very clean, pleasing look, and as discussed above, an energy efficient one.

Figure 35:
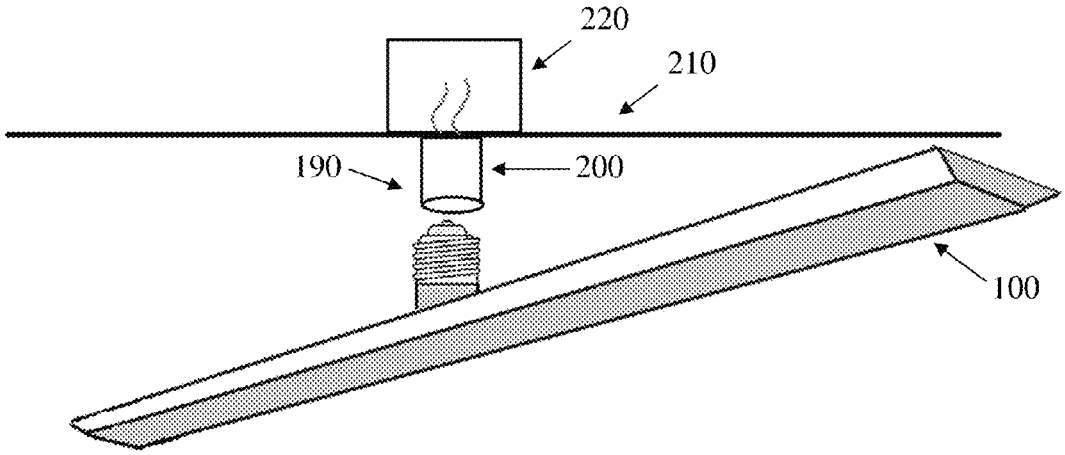
FIG. 35 is an isometric view of the LED module of FIG. 10 with a bulb screw base.

FIG. 35 provides for an LED module with a bulb screw base. In this version of the design, a standard screw type (Edison style, such as E12, E17, E26, E39, etc.) or pin type (GU10, G9, G24, etc.), or any other type of lamp base shown in FIG. 37, can be integrated onto the back side of the LED module 100. As a result, the LED module 100 can be light enough in weight that it can easily and safely be mounted to a lamp holder 200 that may be installed in or on a ceiling 210 or junction box 220. A person skilled in the art will recognize that this type of installation can be useful in a variety of contexts, including homes or other buildings that do not have drop down ceilings.

Figure 36:
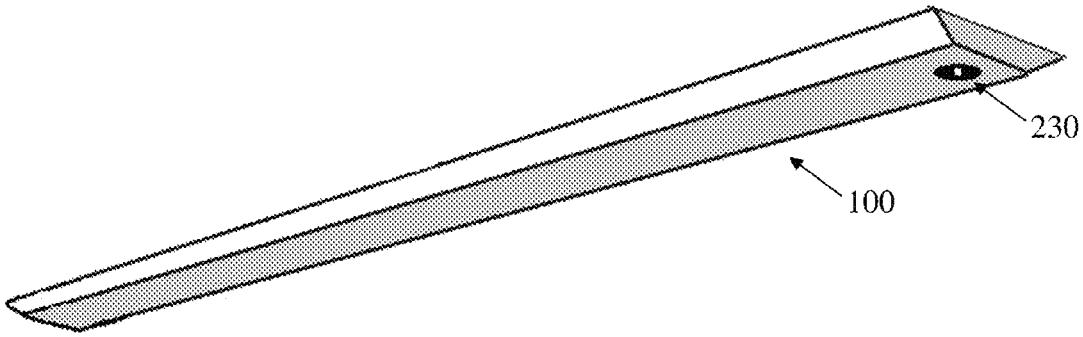
FIG. 36 is an isometric view of the LED module of FIG. 10 with a built in control system.

FIG. 36 illustrates an LED module having a built in control system. The control system can have a number of different configurations, including configurations known to those skilled in the art, but in the illustrated embodiment the control system is a photo sensor 230 integrated into the LED module 100. The photo sensor 230 can be used to control a number of different features, including but not limited to an on/off feature, motion detection, or dimming of the LED module 100.

Figure 37:
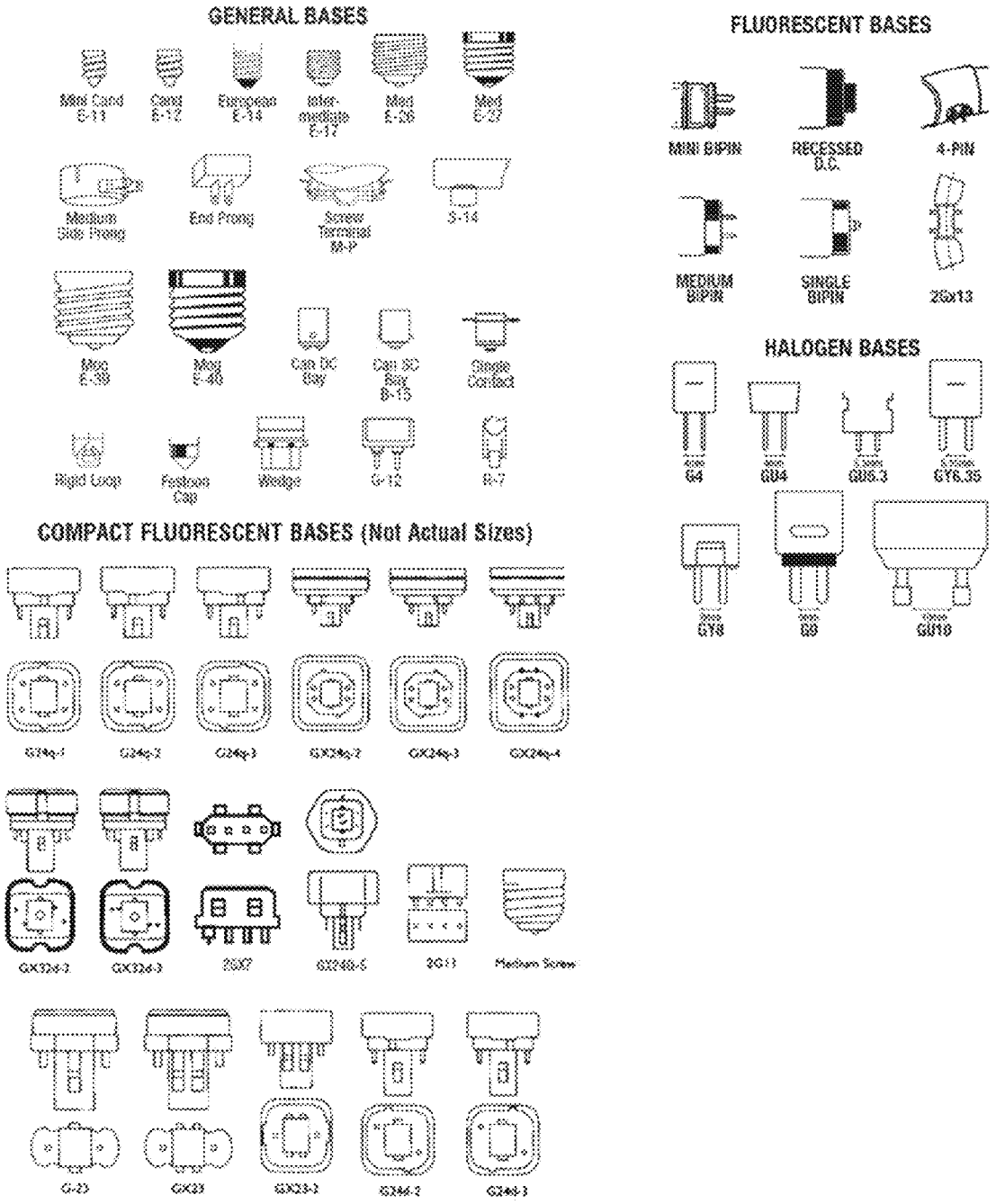
FIG. 37 is a schematic chart illustrating examples of common standardized lamp bases for use in conjunction with LED modules of the nature described herein.

FIG. 37 illustrates a number of different examples of standardized lamp bases that can be used in conjunction with the various embodiments of the LED modules described herein. The inclusion of these bases in no way limits the size, shape, and type of bases or other components with which the LED modules described herein can be used, but instead merely provides examples of the types of lamp bases that can be effectively used in association with the systems, devices, and methods described herein.

In one exemplary embodiment, a kit for installing a light fixture can be provided. The kit can include either or both of one or more of the thin panels 08 and the ceiling tiles 09, as well as at least one LED module, such as the LED module 100, that can be configured to be integrated with either or both of the panels 08 and tiles 09. Alternatively, or additionally, LED panels can come preassembled with the LED modules 100 already associated with the panels 08 and tiles 09, such as the LED panels 110 and 120. The kit can further include an instruction manual that provides directions complementary to the various installation methods described and contemplated herein. For example, if the kit includes one or more thin panels 08 and/or LED panels 110, the instruction manual can provide directions for installing the panels 08, LED modules 100, and/or the LED panels 110 over a preexisting light fixture, such as a troffer. Likewise, if the kit includes one or more ceiling tiles 09 and/or LED panels 120, the instruction manual can provide directions for installing the tiles 09, LED modules 100, and/or the LED panels 120 in a ceiling grid.

A person skilled in the art will appreciate further features and advantages of the disclosure based on the above-described embodiments. The invention is not to be limited by what has been particularly shown and described, except as indicated by the appended claims. Accordingly, to the extent components and features are described with respect to one form of light module, of component thereof, or one method for installing or replacing a light fixture, a person skilled in the art would understand how to adapt these components and features across the various configurations and embodiments provided herein. By way of non-limiting example, the LEDs 370 that can be used for emergency lighting purposes as described with respect to the LED module 330 of FIG. 25 can be incorporated to and adapted for any lighting module provided for herein. All publications and references cited herein are expressly incorporated herein by reference in their entirety.

What is claimed is:

1. A method for installing a lighting element in a pre-installed troffer, comprising:

selecting a thin panel sized to fit an opening of the troffer and having at least one LED module integrated therewith, the LED module being disposed in a channel formed in an inner surface of an optical body having at least one parabolic-shaped cavity, the inner surface including at least a portion thereof that is reflective, and the optical body being mounted to a front face of the thin panel;

removing electrical enclosures of a troffer to provide access to electrical connections, thereby allowing the troffer to serve as a junction box;

electrically connecting the at least one LED module to the electrical connections;

re-installing at least a portion of the removed electrical enclosures of the troffer; and positioning the thin panel below a bottom portion of the troffer.

2. The method of claim 1, further comprising:

mounting a driver adjacent to the thin panel; and electrically connecting the driver to the at least one LED module.

3. The method of claim 1, further comprising disconnecting a line potential from a ballast of the troffer.

4. The method of claim 1, wherein a weight of the thin panel and the at least one LED module is negligible such that a cabling system associated with the troffer does not require adjustment to account for additional weight of the light fixture.

5. A method for installing a light fixture, comprising:

selecting a ceiling tile having an optical body with at least one parabolic-shaped cavity with an inner surface that includes at least a portion thereof that is reflective and at least one LED module disposed in a channel formed in the inner surface of the optical body;

electrically connecting the at least one LED module to electrical connections disposed adjacent to a ceiling grid; and positioning the ceiling tile in the ceiling grid.

6. The method of claim 5, wherein the ceiling tile has a junction box integrated therewith, the junction box being configured to be part of the electrical connections made between the at least one LED module and the electrical connections disposed adjacent to the ceiling grid.

7. The method of claim 5, further comprising:

selecting a location of the ceiling tile such that it is adjacent to a junction box;

using the junction box to make electrical connections between the at least one LED module and the electrical connections disposed adjacent to the ceiling grid.

8. The method of claim 5, wherein a weight of the ceiling tile, the optical body, and the at least one LED module is negligible such that a cabling system associated with the ceiling tile does not require adjustment to account for additional weight of the ceiling tile, the optical body, and the at least one LED module.

9. A light fixture, comprising:

a thin panel;

an optical body having at least one parabolic-shaped cavity, the cavity having an inner surface that includes at least a portion thereof that is reflective, and the optical body being mounted to a front face of the thin panel;

at least one LED module having an LED package in electrical communication with a driver, the LED package being mounted to a circuit board, the LED module being disposed in a channel formed in the inner surface of the optical body; and a troffer having a top, a bottom, and a ballast compartment, the bottom having an opening through which light passes, and the ballast compartment being configured to provide electrical connections to the driver and the LED package, wherein the thin panel is configured to mate to the troffer to cover at least a portion of the opening of the troffer such that light from the LED module is reflected out of the optical body by a portion of the inner surface that is reflective from a location that is below the top of the troffer.

10. The light fixture of claim 9, wherein the driver is disposed within the LED module.

11. The light fixture of claim 9, wherein the LED module further comprises optics configured to assist in at least one of: focusing light emanating from the LED module, reducing glare from light emanating from the LED module, and reducing hot spots of the LED module.

12. The light fixture of claim 9, further comprising a diffuser configured to assist in reducing glare from light emanating from the LED module.

13. The light fixture of claim 9, wherein a top portion of the circuit board of the LED module sits flush with a portion of the inner surface that is reflective.

14. A light fixture, comprising:

a ceiling tile having a front face and a back face;

an optical body having at least one parabolic-shaped cavity, the cavity having an inner surface that includes at least a portion thereof that is reflective, and the optical body being mounted to the front face of the ceiling tile;

at least one LED module having an LED package in electrical communication with a driver, the LED package being mounted to a circuit board, the LED module being disposed in a channel formed in the inner surface of the optical body; and a junction box located proximate to the back face of the ceiling tile, the junction box being configured to provide electrical connections to the driver and the LED package, wherein electrical power is provided to the junction box, and thus to the driver and the LED package, such that light from the LED module is reflected out of the optical body to an outside environment by a portion of the inner surface that is reflective.

15. The light fixture of claim 14, wherein the driver is disposed within the LED module.

16. The light fixture of claim 14, wherein the driver is located proximate to the back face of the ceiling tile.

17. The light fixture of claim 14, wherein the LED module further comprises optics configured to assist in at least one of: focusing light emanating from the LED module, reducing glare from light emanating from the LED module, and reducing hot spots of the LED module.

18. The light fixture of claim 14, further comprising a diffuser configured to assist in reducing glare from light emanating from the LED module.

19. The light fixture of claim14, wherein a top portion of the circuit board of the LED module sits flush with a portion of the inner surface that is reflective.

* * * * *